US012253287B2

(12) United States Patent
Papoulis et al.

(10) Patent No.: US 12,253,287 B2
(45) Date of Patent: Mar. 18, 2025

(54) RECEIVER DRIER AND ECONOMIZER INTEGRATION FOR VAPOR INJECTION SYSTEM

(71) Applicant: Hanon Systems, Daejeon (KR)

(72) Inventors: Evangelos Papoulis, Northville, MI (US); Gary Komora, Westland, MI (US); Nicos Agathocleous, Canton, MI (US); Arulkumar Rajenderan, Rochester Hills, MI (US); Jason Ryu, Belleville (CA)

(73) Assignee: HANON SYSTEMS, Daejeon (KR)

( * ) Notice: Subject to any disclaimer, the term of this patent is extended or adjusted under 35 U.S.C. 154(b) by 193 days.

(21) Appl. No.: 18/165,689

(22) Filed: Feb. 7, 2023

(65) Prior Publication Data

US 2023/0349604 A1 Nov. 2, 2023

Related U.S. Application Data

(60) Provisional application No. 63/362,248, filed on Mar. 31, 2022.

(51) Int. Cl.

| | |
|---|---|
| ***F25B 40/02*** | (2006.01) |
| ***F25B 39/04*** | (2006.01) |
| ***F25B 41/42*** | (2021.01) |

(52) U.S. Cl.

CPC ..... *F25B 40/02* (2013.01); *F25B 39/04* (2013.01); *F25B 41/42* (2021.01);
(Continued)

(58) Field of Classification Search

CPC ..... F25B 40/00; F25B 40/02; F25B 39/04; F25B 41/42; F25B 2339/0441;
(Continued)

(56) References Cited

U.S. PATENT DOCUMENTS

| | | | |
|---|---|---|---|
| 4,232,533 | A | 11/1980 | Lundblad et al. |
| 2003/0010046 | A1 | 1/2003 | Freund et al. |
| 2008/0302129 | A1 | 12/2008 | Mosemann et al. |

FOREIGN PATENT DOCUMENTS

| | | | |
|---|---|---|---|
| DE | 4119257 A1 * | 12/1992 | |
| EP | 2500676 A1 * | 9/2012 | ..... F25B 13/00 |

(Continued)

*Primary Examiner* — Emmanuel E Duke
(74) *Attorney, Agent, or Firm* — James D. Miller; Shumaker, Loop & Kendrick, LLP

(57) ABSTRACT

An integrated receiver drier and economizer (RDE) includes a tank having a hollow interior receiving a first flow of a refrigerant therein, the first flow of the refrigerant including a liquid phase of the refrigerant accumulating within a liquid containing portion of the hollow interior of the tank. An economizer receiving a second flow of the refrigerant through an interior thereof is at least partially submerged in the liquid containing portion of the tank. The economizer forms a heat exchanging structure configured to exchange heat between the first flow of the refrigerant passing over an exterior of the economizer and the second flow of the refrigerant passing through the interior of the economizer. A desiccant is disposed in the liquid containing portion of the tank downstream of the economizer with respect to the first flow of the refrigerant through the hollow interior of the tank.

20 Claims, 9 Drawing Sheets

(52) U.S. Cl.
CPC ... *F25B 2339/0441* (2013.01); *F25B 2400/13* (2013.01); *F25B 2400/16* (2013.01)

(58) Field of Classification Search
CPC ..... F25B 2400/13; F25B 2400/16; F25B 2500/01; F25B 2500/17; F25B 2500/14; F25B 5/02; F25B 35/04; F25B 43/003; F28D 9/0006; F28D 9/0043; F28D 2021/0068; F28F 3/044
See application file for complete search history.

(56) References Cited

FOREIGN PATENT DOCUMENTS

| | | | | |
|---|---|---|---|---|
| EP | 2500676 | B1 | 7/2019 | |
| JP | H06177459 | A | 6/1994 | |
| JP | 2013015233 | A | 1/2013 | |
| KR | 2019950001062 | Y1 | 2/1995 | |
| KR | 100522405 | B1 * | 10/2005 | ..... F25B 41/37 |

* cited by examiner

RECEIVER DRIER AND ECONOMIZER INTEGRATION FOR VAPOR INJECTION SYSTEM

CROSS-REFERENCE TO RELATED APPLICATION

This patent application claims priority to U.S. Provisional Patent Application Ser. No. 63/362,248, filed on Mar. 31, 2022, the entire disclosure of which is hereby incorporated herein by reference.

FIELD OF THE INVENTION

The invention relates to a vapor injection system, and more particularly, to an integrated receiver drier and economizer for a refrigerant circuit having a compressor utilizing vapor injection.

BACKGROUND

As is commonly known, vehicles typically include a heating, ventilating, and air conditioning (HVAC) system. In certain applications, a compressor utilizing vapor injection is employed for compressing a refrigerant circulated through a refrigerant circuit of the HVAC system. Such a compressor may be a vapor injection scroll compressor, as one example. Such a vapor injection compressor utilizes two different inputs of the refrigerant at different pressures and/or temperatures for optimizing the capacity of the vapor injection compressor in comparison to a single input compressor. This is typically achieved by returning a portion of the refrigerant back towards the vapor injection compressor after initially exiting the compression chamber(s) of the vapor injection compressor. Depending on the configuration of the refrigerant circuit, a temperature and/or pressure of the refrigerant may be altered prior to reentry back into the vapor injection compressor to ensure that the returned refrigerant has the desired characteristics for the given mode of operation of the HVAC system utilizing such vapor injection. The returned refrigerant may also be utilized to exchange heat with refrigerant flowing through other portions of the refrigerant circuit for further altering the heating or cooling capacity of the non-returned refrigerant prior to entry into a heat exchanger such as an evaporator of the refrigerant circuit.

For example, one known configuration of a refrigerant circuit having a vapor injection compressor includes the refrigerant flowing through a condenser after exiting a discharge side of the vapor injection compressor before then encountering a receiver drier where a liquid portion of the refrigerant is accumulated and temporarily stored. The receiver drier also includes a desiccant for absorbing moisture when the refrigerant passes through the receiver drier. Downstream of the receiver drier, a vapor injection return pathway branches from the primary refrigerant circuit and leads to an injection port of the vapor injection compressor where the returned refrigerant is injected into the corresponding compression chamber of the vapor injection compressor. An economizer is disposed along each of the primary refrigerant circuit and the vapor injection return pathway, and an expansion element is disposed along the vapor injection return pathway upstream of the economizer.

The economizer refers to a heat exchanger configured for exchanging heat between the returned vapor injection refrigerant (after expansion within the expansion element) and the refrigerant flowing along the primary refrigerant circuit downstream of the branching of the vapor injection return pathway. The expansion of the returned refrigerant within the expansion element results in the returned refrigerant being relatively cool when passing through the vapor injection side of the economizer, which in turn leads to a cooling of the refrigerant continuing downstream of the economizer on the primary circuit side thereof. The use of the economizer accordingly results in the refrigerant flowing along the primary refrigerant circuit having a greater cooling capacity when reaching a downstream-arranged evaporator or chiller of the refrigerant circuit. The vapor injection feature may accordingly be utilized when especially high cooling demands are placed on the corresponding HVAC system, such as when a high degree of air-cooling is required for the air entering the passenger compartment of a vehicle.

A refrigerant circuit utilizing such a receiver drier and economizer configuration requires multiple fluid connections and intervening fluid lines to achieve the described flow configuration between the various components forming the vapor injection system. However, the packaging space in modern vehicles is extremely limited, and the described configuration accordingly presents challenges for properly packaging such components while maintaining efficient operation of the vapor injection system.

There is, therefore, a need for a vapor injection system, wherein a packaging space required for all of the components of the vapor injection system is minimized while an efficiency of the vapor injection system is maximized.

SUMMARY OF THE INVENTION

Consistent and consonant with an embodiment of the present invention, an improved vapor injection system, wherein a packaging space required for all of the components of the vapor injection system is minimized while an efficiency of the vapor injection system is maximized is surprisingly discovered.

According to one embodiment of the present invention, an integrated receiver drier and economizer comprises a tank having a hollow interior receiving a first flow of a refrigerant therein with the first flow of the refrigerant including a liquid phase of the refrigerant accumulating within a liquid containing portion of the hollow interior of the tank. An economizer receiving a second flow of the refrigerant through an interior thereof is at least partially submerged in the liquid containing portion of the tank. The economizer forms a heat exchanging structure configured to exchange heat between the first flow of the refrigerant passing over an exterior of the economizer and the second flow of the refrigerant passing through the interior of the economizer.

According to another aspect of the present invention, a refrigerant circuit comprises a primary circuit including, in an order of a first flow of a refrigerant therethrough, a vapor injection compressor, a condenser, a tank, a primary expansion element, and an evaporator, wherein the tank has a hollow interior including a liquid containing portion occupied by a liquid phase of the first flow of the refrigerant. A vapor injection branch pathway extends from a branch point disposed between the condenser and the tank along the primary circuit to a vapor injection port of the vapor injection compressor. The vapor injection branch pathway includes, in an order of a second flow of the refrigerant therethrough, a branch expansion element and an economizer. The economizer is at least partially submerged within the liquid containing portion of the tank. The economizer is a heat exchanging structure configured to exchange heat between the first flow of the refrigerant passing over an exterior of the economizer and the second flow of the refrigerant passing through an interior of the economizer.

BRIEF DESCRIPTION OF THE DRAWINGS

Further details, features and advantages of configurations of the invention emerge from the following description of exemplary embodiments with reference to the associated figures.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

A" and "an" as used herein indicate "at least one" of the item is present; a plurality of such items may be present, when possible. Spatially relative terms, such as "front," "back," "inner," "outer," "bottom," "top," "horizontal," "vertical," "upper," "lower," "side," "above," "below," "beneath," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures.

As used herein, substantially is defined as "to a considerable degree" or "proximate" or as otherwise understood by one ordinarily skilled in the art or as otherwise noted. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Where any conflict or ambiguity may exist between a document incorporated by reference and this detailed description, the present detailed description controls. Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section, depending on the context or circumstance.

Figure 1:
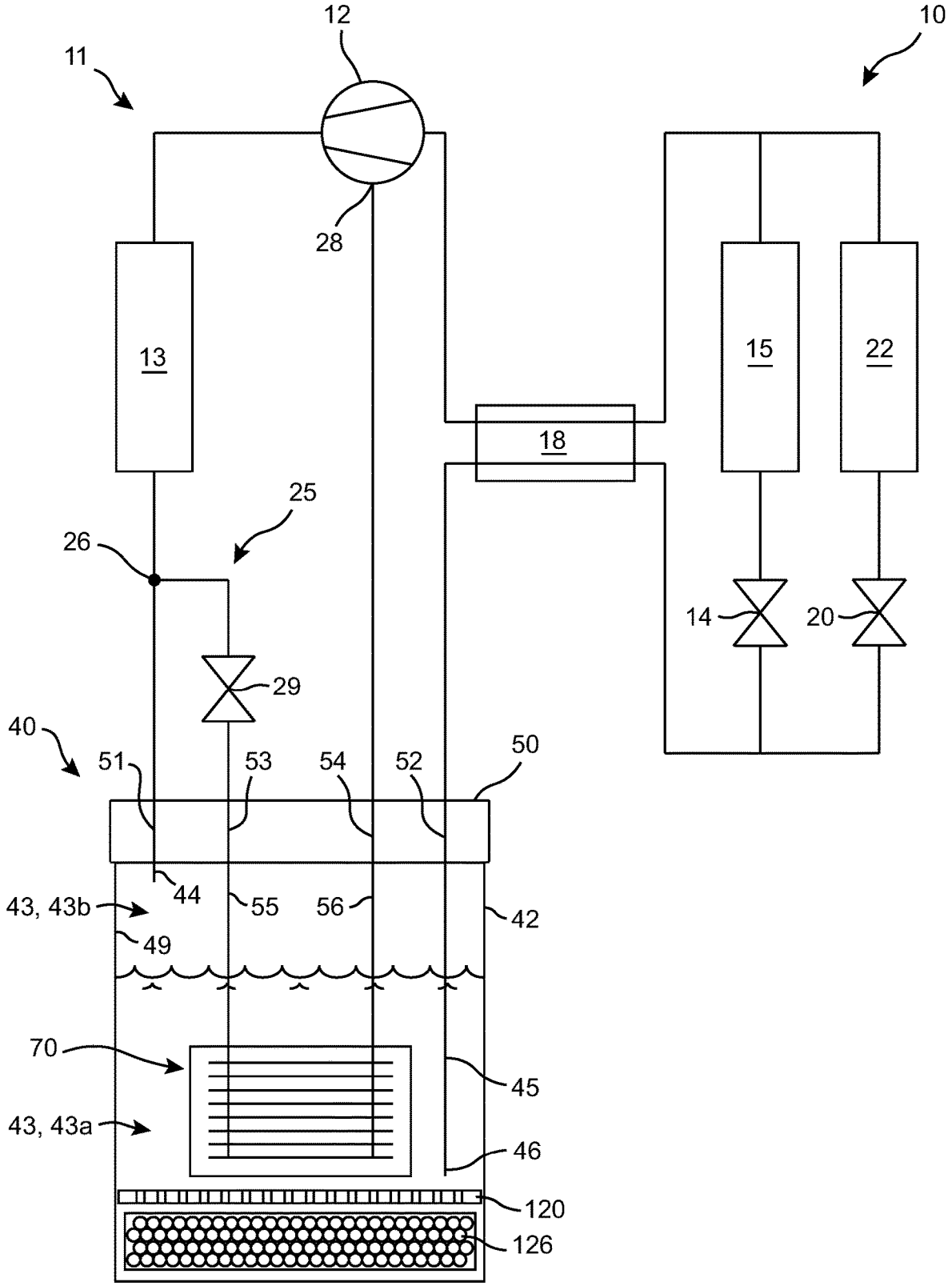
FIG. 1 is a schematic illustration of a refrigerant circuit including an integrated receiver drier and economizer according to an embodiment of the present disclosure.

FIG. 1 illustrates a refrigerant circuit 10 having an integrated receiver, drier, and economizer (RDE) 40 according to an embodiment of the present invention. The refrigerant circuit 10 may form a portion of a thermal management system of a vehicle. The vehicle may be a hybrid or electric vehicle relying upon stored electrical power to provide heat to various components of the vehicle as well as the air to be delivered to the passenger cabin of the vehicle via the operation of the thermal management system and the corresponding refrigerant circuit 10, although the present invention is not necessarily limited to use in such a vehicle.

The refrigerant circuit 10 includes a primary circuit 11 having at least a compressor 12, a condenser 13, the RDE 40, an expansion element 14, and an evaporator 15. The primary circuit 10 may also include an internal heat exchanger 18, a secondary expansion element 20, and a chiller 22. The refrigerant circuit 10 is shown in substantially simplified schematic form in FIG. 1 and may include additional flow paths, valves, and/or components from those illustrated without necessarily departing from the scope of the present invention, so long as the same relationships are present within the refrigerant circuit 10 for prescribing operation thereof in the manner described hereinafter, and especially with regards to the operation of the disclosed RDE 40 and associated components thereof.

The compressor 12 is a vapor injection compressor having a vapor injection capability wherein refrigerant is selectively returned to the compressor and injected into a compression chamber of the compressor. The returned refrigerant is injected as a gaseous vapor at an intermediate pressure between a suction pressure and a discharge pressure of the corresponding compressor for increasing the pressure of the refrigerant contained within the compression chamber. The compressor 12 is generally configured to increase a pressure and temperature of the refrigerant while in a gaseous state. The vapor injection compressor may be a vapor injection scroll compressor having variable compression chambers formed between a fixed scroll and an orbiting scroll, wherein an orbiting of the orbiting scroll relative to the fixed scroll results in a radial inward reduction in volume of each of the compression chambers. Each of the compression chambers may receive the refrigerant at the suction pressure at one or more inlets disposed at a radial outer portion of the fixed scroll and may discharge the refrigerant at the discharge pressure at an outlet disposed at a radial center of the fixed scroll, and each of the injection ports utilized in injecting the vapor into the compression chambers may be disposed radially intermediate the inlet(s) and the outlet. One-way valves may be utilized at each injection port to ensure that the refrigerant is only injected into the compression chambers when the refrigerant is at a pressure higher than that instantaneously within the compression chamber as the shape and position of the compression chamber changes while moving radially inwardly, thereby ensuring that the injection process results in an increase in the pressure of the refrigerant in the compression chamber into which the vapor is injected. However, any form of compressor utilizing such injection of the refrigerant in a gaseous form and at a pressure intermediate the suction pressure and the discharge pressure of the associated compressor may be utilized in conjunction with the present invention without departing from a scope of the present invention.

The condenser 13 is a heat exchanger configured to remove heat from the high temperature and high pressure refrigerant exiting the compressor 12. The refrigerant exiting the condenser 13 may be partially liquid and partially gaseous in phase. The condenser 13 may be in heat exchange communication with any other fluid suitable for removing heat from the refrigerant within the condenser 13. In some embodiments, the condenser 13 may be a water-cooled condenser (WCC) in fluid communication with a liquid coolant of an associated fluid system of the vehicle, such as a coolant system utilized in cooling various components of the vehicle. In other embodiments, the condenser 13 may be a radiator configured to exchange heat with ambient air. In still other embodiments, the condenser 13 may be a heating heat exchanger disposed within an HVAC casing (not shown) of the vehicle, and may be configured to heat air delivered to a passenger compartment of the vehicle.

Figure 2:
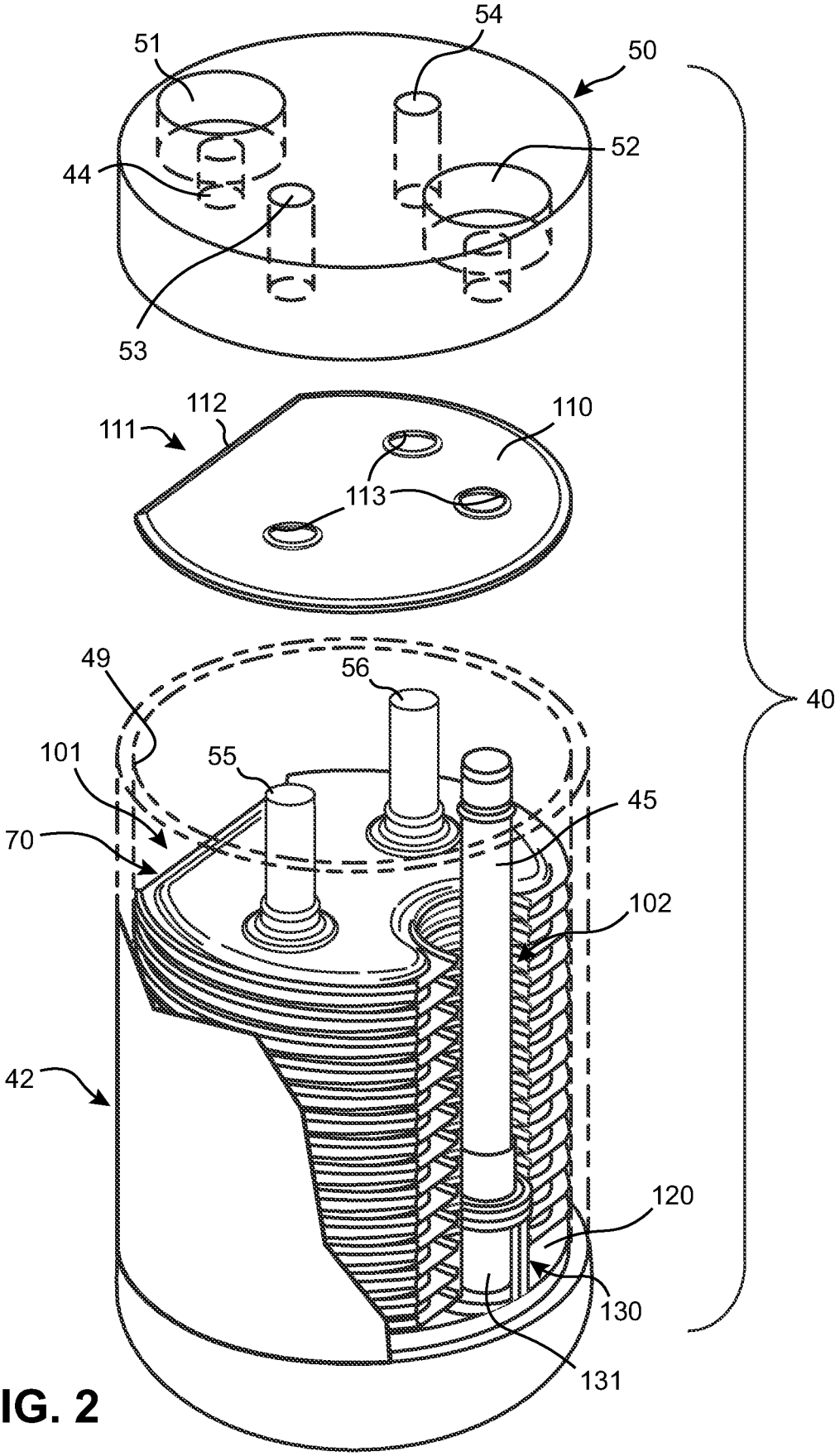
FIG. 2 is an exploded perspective view of the integrated receiver drier and economizer of FIG. 1 showing a tank thereof as partially transparent for revealing a hollow interior of the tank.

The RDE 40 includes a tank 42 having a hollow interior 43 into which the refrigerant exiting the condenser 13 flows as the two-phase liquid and gaseous form. The refrigerant of the primary circuit is in fluid communication with the hollow interior 43 of the tank 42 via each of a dispensing conduit 44 and a pick-up conduit 45. The tank 42 is arranged to include an axial direction thereof arranged parallel to the direction of gravity to cause the liquid phase of the refrigerant to fall downward from the dispensing conduit 44 to accumulate at a bottom portion of the tank 42, wherein an end of the dispensing conduit 44 may be positioned and oriented to cause the refrigerant to enter the tank 42 at or adjacent an upper end of the hollow interior 43. In some embodiments, the dispensing conduit 44 may be provided as an opening 51 formed within a cap 50 utilized to delimit the hollow interior 43 with respect to the upward vertical direction, wherein the opening 51 formed within the cap 50 opens into the hollow interior 43. Such a configuration is shown in FIG. 2. In other embodiments, the dispensing conduit 44 may be a pipe that depends downwardly from the opening 51 formed in the cap 50 to include a distal end of the dispensing conduit 44 within the hollow interior 43, as shown schematically in FIG. 1. The distal end of the dispensing conduit 44 may be arranged at an angle relative to the axial direction of the tank 42 to promote the liquid refrigerant falling at an angle for reaching a desired position within the tank 42. The pick-up conduit 45 depends downwardly from a corresponding opening 52 formed in the cap 50 to ensure fluid communication with the liquid refrigerant disposed within the tank 42. Each of the described openings 51, 52 formed within the cap 50 may be associated with any necessary structure such as suitable fluid couplings or fluid fittings associated with fluidly coupling an associated fluid line to each of the described conduits 44, 45. For example, a block type seal fitting may be utilized at each junction of one of the external fluid lines with the cap 50 to prevent leakage of the refrigerant where the primary circuit 11 passes through the RDE 40.

Figure 3:
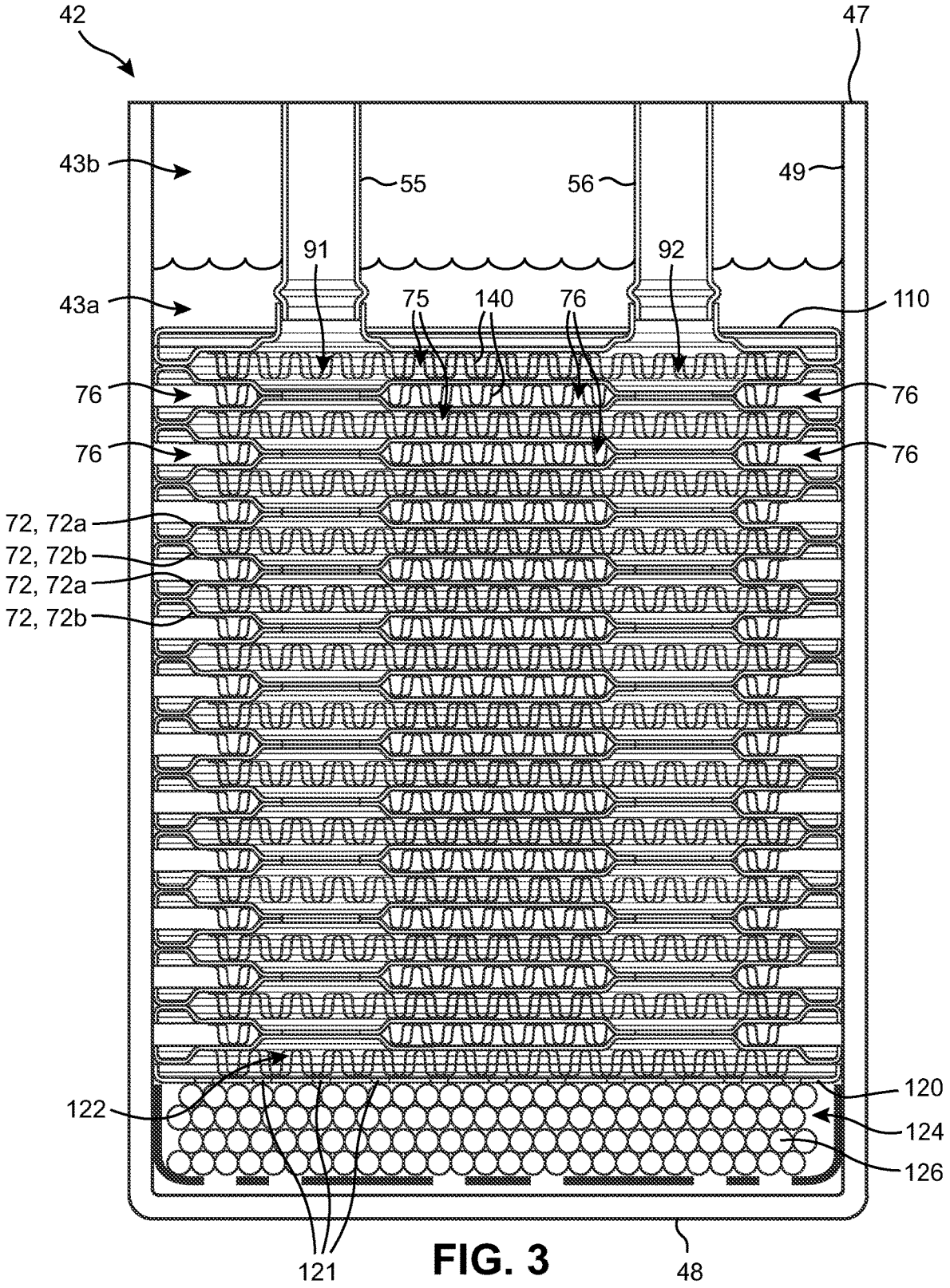
FIG. 3 is an elevational cross-sectional view taken through a pair of manifold chambers of the economizer of the integrated receiver drier and economizer of FIG. 1.

As shown in each of FIGS. 1 and 3, the accumulation of the liquid refrigerant within the tank 42 causes the hollow interior 43 to be divided axially into a liquid containing portion 43*a* occupied by the liquid refrigerant at the lower end of the hollow interior 43 and a gas containing portion 43*b* occupied by the gaseous refrigerant at a position above the liquid containing portion 43*a* and towards the upper end of the hollow interior 43. The pick-up conduit 45 includes an inlet end 46 that is disposed to be submerged within the liquid containing portion 43*a* of the hollow interior 43 adjacent the lower end thereof to cause the liquid phase of the refrigerant contained within the tank 42 to flow towards the downstream arranged expansion element 14 and evaporator 15 via the pick-up conduit 45.

The division of the hollow interior 43 into the liquid containing portion 43*a* and the gas containing portion 43*b* may vary during operation of the refrigerant circuit 10 as different operating modes are utilized requiring different quantities of the refrigerant circulating through the refrigerant circuit 10. Specifically, when demands are relatively low, the level of the liquid refrigerant forming the liquid containing portion 43*a* may be relatively high and towards the cap 50 of the tank 42. In contrast, when demands are relatively high, the level of the refrigerant lowers to a level closer to an upper surface of a heating exchanging structure of the economizer 70, although the heat exchanging structure of the economizer 70 also remains submerged within the liquid containing portion 43*a* regardless of the selected operating mode. The refrigerant circuit 10 may include the necessary amount of refrigerant to maintain the liquid refrigerant at desirable levels within the tank 42 in accordance with all such operating modes. Additionally, the refrigerant circuit 10 may include an additional supply of refrigerant constituting a charge reserve of the liquid refrigerant stored within the tank 42, wherein such a charge reserve of the liquid refrigerant refers to an amount of the liquid refrigerant supplied for replacing any liquid refrigerant incidentally exiting the refrigerant circuit 10 during use thereof. Additional features of the RDE 40 are described in detail hereinafter when describing an economizer 70 integrated into the RDE 40 and forming a portion of a vapor injection branch pathway 25 branching from the primary circuit 11 downstream of the condenser 13.

The expansion element 14 may refer to any structure or device for contracting and then expanding a flow of the refrigerant therethrough such that a temperature and a pressure of the refrigerant are each lowered following passage through the expansion element 14. The expansion element 14 is accordingly configured to lower a temperature and a pressure of the refrigerant passing therethrough prior to entry into the evaporator 15 and following passage through the tank 42 of the RDE 40 via the dispensing and pick-up conduits 44, 45. The expansion element 14 may be referred to as the primary expansion element by virtue of its placement on the primary circuit 11.

The expansion element 14 may be a fixed orifice or may be an adjustable expansion device wherein a flow cross-section through the expansion element 14 may be varied to alter the drop in pressure and temperature of the refrigerant passing therethrough. In some embodiments, the expansion element 14 may be further associated with a shut-off valve (not shown) or may be adjustable to a fully closed position wherein refrigerant cannot pass therethrough, thereby preventing the flow of the refrigerant through the downstream arranged evaporator 15. If provided as an adjustable expansion device, the expansion element 14 may be an electronic expansion valve (EXV) where the flow cross-section through the expansion element 14 is electronically controlled according to an associated control scheme, which may include being adjusted to a fully closed position. The expansion element 14 may alternatively be provided as a thermal expansion valve (TXV) where a temperature of the refrigerant encountering the TXV controls a flow cross-section through the TXV, such as increasing or decreasing the flow cross-section in reaction to an increasing or decreasing temperature of the refrigerant, as the circumstances may warrant. The TXV may also be configured to be adjustable to fully close off flow therethrough, as conditions may warrant based on the configuration of the TXV and the operating parameters thereof.

The evaporator 15 is a heat exchanger configured to add heat to the high temperature and high pressure refrigerant entering the compressor 12 with the refrigerant exiting the evaporator 15 being gaseous in phase. The evaporator 15 may be in heat exchange communication with any other fluid suitable for removing heat from the refrigerant within the evaporator 15. In some embodiments, the evaporator 15 may be a cooling heat exchanger disposed within the HVAC casing (not shown) of the vehicle, and may be configured to cool and/or dehumidify air delivered to a passenger compartment of the vehicle. In other embodiments, the evaporator 15 may be configured to cool a fluid or structural component associated with operation of the vehicle, and may alternatively be referred to as a chiller in such circumstances.

The secondary expansion element 20 and the chiller 22 may be disposed in a parallel flow configuration relative to the expansion element 14 and the evaporator 15 such that the refrigerant may flow through the expansion element 14 and the evaporator 15 and/or the secondary expansion element 20 and the chiller 22, depending on the desired operation of the refrigerant circuit 10. It should accordingly be understood that references hereinafter to a flow of the refrigerant through the expansion element 14 and the evaporator 15 may alternatively refer to the refrigerant being distributed to flow through each of the evaporator 15 via the expansion element 14 and the chiller 22 via the secondary expansion 20, or may refer to the refrigerant being exclusively distributed to flow through the chiller 22 via the secondary expansion element 20 absent flow through the evaporator 15, without necessarily departing from the scope of the present invention. It should also be understood that components being described as upstream or downstream of the expansion element 14 and the evaporator 15 are also similarly disposed upstream or downstream of the secondary expansion element 20 and the chiller 22 in the same manner.

In some embodiments, the primary circuit 11 may include the branching of the refrigerant to three or more of the evaporators/chillers at the disclosed position, as necessary, to prescribe the desired cooling to each component or fluid of an associated system. For example, the additional branches of the primary circuit may each be associated with a chiller directly or indirectly (via an intervening fluid) cooling a different electronic component of the vehicle. In other embodiments, the refrigerant circuit 10 may include only the expansion element 14 and the evaporator 15, as desired, in the absence of any form of branching at the illustrated position on the primary circuit 11. The secondary expansion element 20 and any other expansion element associated with any additional chillers and/or evaporators branching from the primary circuit may be provided as any of the examples given with respect to the expansion element 14, including being a fixed orifice, an EXV, or a TXV, as non-limiting examples.

The internal heat exchanger 18 is configured to provide heat exchange communication between a high pressure portion of the refrigerant at a position upstream of the expansion member 14 and the evaporator 15 and a low pressure portion of the refrigerant at a position downstream of the expansion member 14 and evaporator 15. The high pressure portion of the refrigerant has a relatively greater temperature than the low pressure portion of the refrigerant at the internal heat exchanger 18, hence the heat exchange occurring via the internal heat exchanger 18 causes a temperature of the high pressure portion of the refrigerant to be decreased and also causes a temperature of the low pressure portion of the refrigerant to be increased. The decreasing of the temperature of the high pressure portion of the refrigerant leads to a subcooling of the high pressure portion of the refrigerant below the saturation temperature thereof, which in turn leads to a cooling capacity of whichever evaporator 15 or chiller 22 is passed by the refrigerant, depending on the desired operating mode of the refrigerant circuit 10, being increased via the heat exchange occurring within the internal heat exchanger 18 in comparison to a refrigerant circuit devoid of such heat exchange. The low pressure portion of the refrigerant may also be superheated to a temperature above the evaporation temperature of the refrigerant via the heat exchange occurring within the internal heat exchanger 18.

The vapor injection branch pathway 25 branches from the primary circuit 11 at a branch point 26 disposed downstream of the condenser 13 and upstream of the tank 42 of the RDE 40. In the present embodiment, the branch point 26 is also disposed upstream of the internal heat exchanger 18 on the high-pressure side of the primary circuit. The vapor injection branch pathway 25 extends from the branch point 26 to a vapor injection port 28 of the vapor injection compressor 12 where the refrigerant flowing along the vapor injection branch pathway 25 is able to selectively enter a compression chamber of the vapor injection compressor 12 when exceeding the instantaneous pressure of the refrigerant within the corresponding compression chamber. The branch pathway 25 includes, in an order of flow therethrough from the branch point 26 to the vapor injection port 28, a branch expansion element 29 and the economizer 70.

The branch expansion element 29 may be provided as any form of adjustable expansion device having the capability of varying a flow cross-section therethough for varying the extent of the temperature drop and pressure drop experienced by the refrigerant passing therethrough. The adjustable expansion device may also be configured to be adjustable to a fully closed position to prevent passage of the refrigerant through the branch pathway 25 and to the injection port 28 of the compressor 12 during periods of time when the benefits of the vapor injection process are not required for desirably operating the refrigerant circuit 10, such as when the cooling demands placed on the evaporator 15 and/or the chiller 22 are relatively low and not in need of the sub-cooling provided by the economizer 70, as explained hereinafter. The branch expansion element 29 may be a TXV or an EXV as explained previously with respect to the expansion element 14. If a TXV is utilized, the TXV may be configured to be opened only when the refrigerant encountering the branch expansion element 29 is above a threshold temperature, below a threshold temperature value, or within a range of temperature values, as the circumstances may warrant, for ensuring that the vapor injection process occurs only when the characteristics of the refrigerant indicate the need for such a process in order to meet the requirements of the refrigerant circuit 10. The TXV may also be configured to vary the cross-sectional flow area through the branch expansion element 29 based on the temperature of the refrigerant encountering the TXV.

If an EXV is utilized, the EXV may similarly be configured to be variably adjustable such that the EXV is configured to be opened only when the refrigerant encounters a sensor associated with operation of the EXV that determines that the refrigerant is above a threshold temperature, below a threshold temperature value, or within a range of temperature values. The sensor may be disposed adjacent the EXV or may be associated with measuring the temperature of the refrigerant at another location along the refrigerant circuit 10, such as measuring the temperature of the refrigerant prior to entry into the expansion element 14 or the evaporator 15. In other circumstances, a control system of the vehicle associated with operation of the components forming the refrigerant circuit 10 may be configured to open the EXV according to a user selected setting or the like, such as a change in operating mode of the refrigerant circuit 10 requiring use of the branch pathway 25. In either circumstance, it should be understood that the branch pathway 25 is configured to only be utilized when the vapor injection process is needed for a certain mode of operation able to be achieved via the refrigerant circuit 10, such as when it is desired to increase the cooling capacity of the evaporator 15 in the manner described above. It should accordingly be understood that the disclosed refrigerant circuit 10 is operable in the absence of the passage of the refrigerant along the branch pathway 25 with respect to certain operating modes thereof.

The refrigerant exits the branch expansion element 29 as a two-phase refrigerant including a gaseous phase and a liquid phase. The economizer 70 of the integrated RDE 40 is configured to act as a form of an evaporator of the branch pathway 25 where the liquid refrigerant entering the economizer 70 is evaporated therein to result in the refrigerant exiting the economizer 70 and flowing towards the vapor injection port 28 of the compressor 12 as a purely gaseous refrigerant capable of injection into a corresponding compression chamber of the compressor 12. The evaporating of the refrigerant within the economizer 70 occurs via a transfer of heat from the relatively hot liquid refrigerant forming the liquid containing portion 43*a* of the tank 42 exterior to the economizer 70 to the relatively cooler two-phase refrigerant passing through the interior of the economizer 70. This transfer of heat results in a decrease in temperature of the liquid refrigerant within the tank 42, thereby causing a reduction in temperature of the liquid refrigerant exiting the liquid containing portion 43*a* via the pick-up conduit 45 for flow downstream to the expansion element 14 and the evaporator 15. The economizer 70 accordingly facilitates a subcooling of the liquid refrigerant exiting the liquid containing portion 43*a* of the tank 42 below the saturation temperature of the corresponding refrigerant for increasing the cooling capacity of the downstream arranged evaporator 15 and/or chiller 22. The gaseous refrigerant exiting the economizer 70 may also be superheated beyond the evaporation temperature of the corresponding refrigerant before entering the injection port 28 of the compressor 12. The economizer 70 accordingly operates in similar fashion to the internal heat exchanger 18 during use of the vapor injection process by cooling a relatively high pressure liquid phase of the refrigerant prior to the refrigerant flowing downstream and encountering the expansion element 14 and the evaporator 15, thereby increasing a cooling capacity of the evaporator 15 (and/or the chiller 22 or any other parallel arranged evaporator/chiller) in comparison to a circuit devoid of such additional subcooling.

Figure 4:
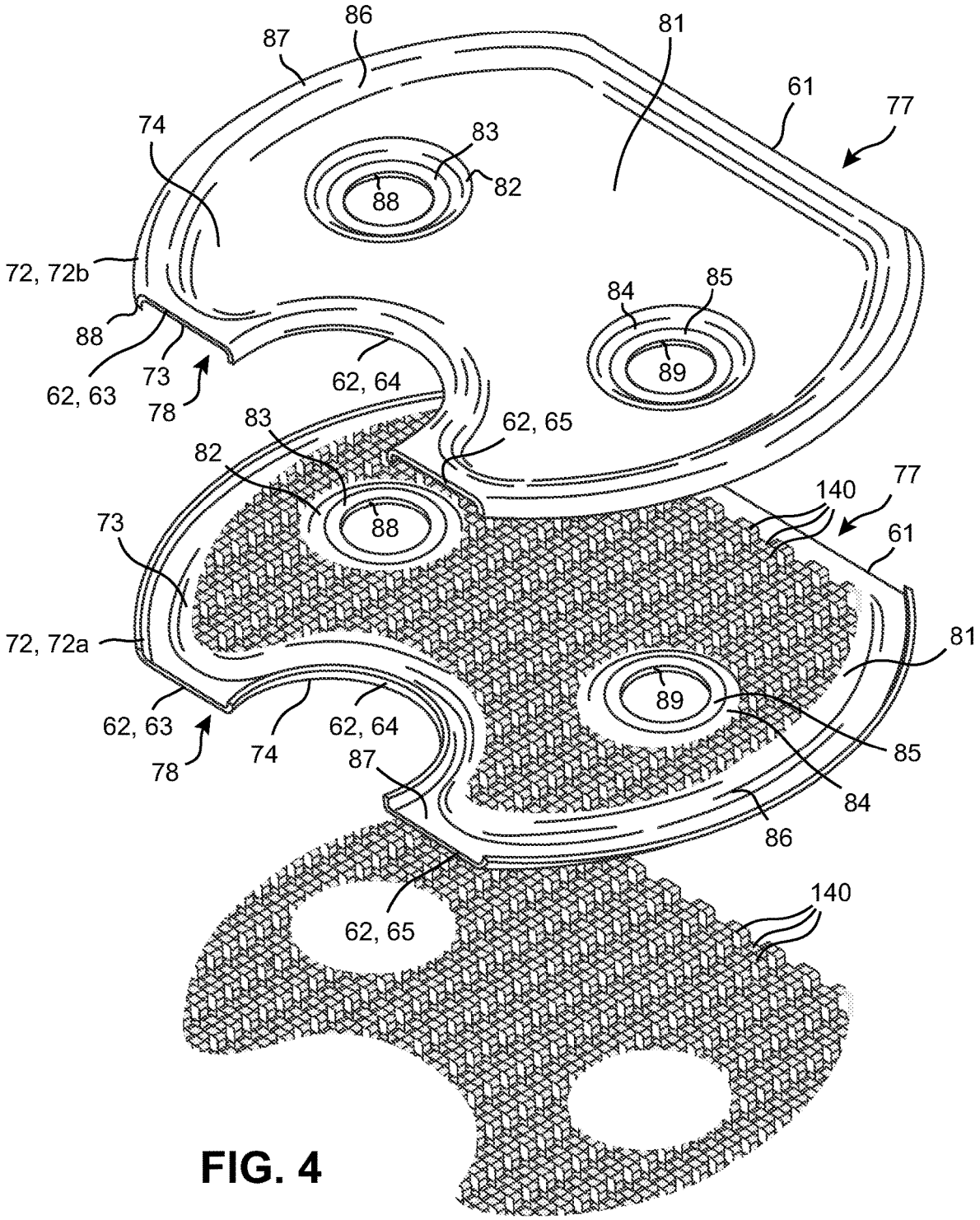
FIG. 4 is an exploded perspective view of an arrangement of stacked plates and fin elements forming the economizer of the integrated receiver drier and economizer of FIG. 1.

Referring now more specifically to FIGS. 2-4, a structure of an exemplary economizer 70 suitable for use with the refrigerant circuit 10 is disclosed. The economizer 70 is provided as a plate-type heat exchanger having a repeating and alternating arrangement of stacked plates 72. Each of the plates 72 is configured to extend substantially perpendicular to the axial direction of the tank 42 when the plates 72 are stacked therein. A thickness of each of the plates 72, which extends primarily in the axial direction of the tank 42, is exceeded by the remaining dimensions of each of the plates 72 in directions arranged perpendicular to the axial direction.

As best shown in FIGS. 3 and 4, each of the plates 72 includes a first major surface 73 and an opposing second major surface 74. The first major surface 73 may be considered an outer or exterior surface of each of the plates 72 configured to encounter the liquid refrigerant disposed within the liquid containing portion 43*a* of the tank 42 and flowing around an exterior of the economizer 70 while the second major surface 74 may be considered an inner or interior surface of each of the plates 72 configured to encounter the gaseous or two-phase refrigerant flowing within the interior of the economizer 70.

Each of the plates 72 includes a planar portion 81, a first axial extension portion 82, a first contact portion 83, a second axial extension portion 84, a second contact portion 85, a third axial extension portion 86, and a third contact portion 87. The planar portion 81 extends along a plane that is arranged perpendicular to the axial direction of the tank 42 and occupies a majority of each of the major surfaces 73, 74 of each of the plates 72. The first axial extension portion 82 and the second axial extension portion 84 are spaced apart from each other with respect to a direction perpendicular to the axial direction of the tank 42 and are disposed within a periphery of the planar portion 81. The first axial extension portion 82 and the second axial extension portion 84 each extend a common distance axially away from the planar portion 81 with respect to a first axial direction of the tank 42.

The first axial extension portion 82 is annular in shape and surrounds the first contact portion 83 and the second axial extension portion 84 is also annular in shape and surrounds the second contact portion 85. The first contact portion 83 and the second contact portion 85 are each planar in configuration and are disposed on a common plane that is spaced apart from the plane of the planar portion 81 by the common axial extension of each of the first and second axial extension portions 82, 84. The first contact portion 83 surrounds a first manifold opening 88 formed through the plate 72 while the second contact portion 85 surrounds a second manifold opening 89 formed through the plate 72.

The third axial extension portion 86 is formed adjacent a periphery of each of the plates 72 and extends to surround the planar portion 81 thereof. The third axial extension portion 86 extends a distance axially away from the planar portion 81 with respect to a second axial direction of the tank 42 arranged opposite the first axial direction thereof. The distance of axial extension of the third axial extension portion 86 may be the same as the common distance of axial extension of each of the axial extension portions 82, 84, although alternative configurations may be utilized, including different distances of axial extension between the portions 82, 84 and the portion 86. The third contact portion 87 is formed around a periphery of the third axial extension portion 86, hence the third contact portion 87 surrounds each of the third axial extension portion 86 and the planar portion 81. The third contact portion 87 is disposed on a plane arranged perpendicular to the axial direction of the tank 42, and is thus arranged perpendicular to the planar portion 81 and each of the remaining contact portions 83, 85.

The third contact portion 87 is shown as further including an axially extending rim 88 extending from select segments of the periphery thereof. The axially extending rim 88 may be positioned to contact an inner circumferential surface 49 of the tank 42 while extending parallel thereto, thereby increasing a surface area of the plate 72 at the inner circumferential surface 49 while also providing an additional flow-guiding surface with respect to certain flow paths formed within the economizer 70. However, the third contact portion 87 may be provided devoid of the rim 88, as desired, without departing from the scope of the present invention.

The plurality of plates 72 forming the economizer 70 includes a plurality of first plates 72*a* and a plurality of second plates 72*b*, wherein the first plates 72*a* and the second plates 72*b* are stacked in alternating fashion with respect to the axial direction of the tank 42. As can be seen in FIGS. 3 and 4, the structure of each of the first plates 72*a* is identical to the structure of each of the second plates 72*b*, but the first plates 72*a* have a different orientation relative to the second plates 72*b*. Specifically, each of the second plates 72*b* is oriented to be mirrored symmetrically relative to each of the first plates 72*a* relative to a plane that is arranged perpendicular to the axial direction of the tank 42. Alternatively, each of the second plates 72*b* may be said to have an orientation rotated 180 degrees from an orientation of each of the first plates 72*a* about an axis that is arranged perpendicular to the axial direction of the tank 42. In either circumstance, the first plates 72*a* and the second plates 72*b* include identical features that extend in opposing axial directions of the tank 42 for forming flow passages both within and around the economizer 70 as explained hereinafter.

The arrangement of the first plates 72*a* relative to the second plates 72*b* results in the first major surface 73 of each of the first plates 72*a* facing towards the first major surface 73 of a first one of the second plates 72*b* disposed adjacent the corresponding one of the first plates 72*a* towards a first axial end 47 of the tank 42 corresponding to an upper end of the tank 42. The disclosed arrangement also results in the second major surface 74 of each of the first plates 72*a* facing towards the second major surface 74 of a second one of the second plates 72*b* disposed adjacent the corresponding one of the first plates 72*a* towards a second axial end 48 of the tank 42 corresponding to a lower end of the tank 42. With respect to each of the first plates 72*a*, each of the first and second axial extension portions 82, 84 extend axially from the corresponding planar portion 81 towards the first axial end 47 while the third axial extension portion 86 extends axially from the corresponding planar portion 81 towards the second axial end 48. In opposite fashion with respect to each of the second plates 72*b*, each of the first and second axial extension portions 82, 84 extend axially from the corresponding planar portion 81 towards the second axial end 48 while the third axial extension portion 86 extends axially from the corresponding planar portion 81 towards the first axial end 47. Each of the first and second contact portions 83, 85 of each of the first plates 72*a* contacts and is coupled to the respective first and second contact portions 83, 85 of a first one of the second plates 72*b* disposed adjacent the corresponding one of the first plates 72*a* towards the first axial end 47 while the third contact portion 87 of each of the first plates 72*a* contacts and is coupled to the third contact portion 87 of a second one of the second plates 72*b* disposed adjacent the corresponding one of the first plates 72*a* towards the second axial end 48. The facing first and second contact portions 83, 85 of each of the pairs of plates 72*a*, 72*b* contact each other along the first major surface 73 of each of the corresponding plates 72*a*, 72*b* while the facing third contact portions 87 of each of the pairs of plates 72*a*, 72*b* contact each other along the second major surface 74 of each of the corresponding plates 72*a*, 72*b*.

As mentioned above, the first major surfaces 73 correspond to surfaces encountering the liquid refrigerant at an outer surface of the economizer 70 while the second major surfaces 74 correspond to surfaces encountering the gaseous or two-phase refrigerant within an interior of the economizer 70. Specifically, a plurality of internal flow passages 75 are formed within the economizer 70 with each of the internal flow passages 75 being defined between the second major surfaces 74 of the facing and coupled together pairs of the plates 72*a*, 72*b* at positions where the second major surfaces 74 are axially spaced apart from one another. A plurality of external flow passages 76 are formed within the liquid containing portion 43*a* of the tank 42 with each of the external flow passages 76 defined between the first major surfaces 73 of the facing and coupled together pairs of the plates 72*a*, 72*b* at positions where the first major surfaces 73 are axially spaced apart from one another. The external flow passages 76 may, in some circumstances, also be partially defined by a corresponding segment of the inner circumferential surface 49 of the tank 42 defining a periphery of the liquid containing portion 43*a* of the tank 42.

As best shown in FIG. 3, the arrangement of the plates 72*a*, 72*b* also results in the axial alignment of the corresponding first and second manifold openings 88, 89 such that the economizer 70 includes an inlet manifold chamber 91 and an outlet manifold chamber 92, each of which extends in an axial direction of the tank 42 through the interior of the economizer 70. Each of the manifold chambers 91, 92 is in fluid communication with each of the internal flow passages 75 formed within the economizer 70. The inlet manifold chamber 91 is configured to receive the two-phase refrigerant exiting the branch expansion element 29 of the branch pathway 25 for distribution to each of the axially spaced apart internal flow passages 75 while the outlet manifold chamber 92 is configured to collect and recombine the refrigerant having passed through each of the internal flow passages 75, which is exclusively in a gaseous state once the refrigerant exits the outlet manifold chamber 92.

The cap 50 of the tank 42 includes an opening 53 that is axially aligned with the inlet manifold chamber 91 as well as an opening 54 that is axially aligned with the outlet manifold chamber 92. Each of the openings 53, 54 may be representative of a fluid conveying portion of the cap 50 associated with connection to one of the external fluid lines forming the branch pathway 25. Specifically, the opening 53 is configured for coupling to the fluid line extending from the branch expansion element 29 and thus receives the refrigerant passing through the branch pathway 25 after expansion therein while the opening 54 is configured for coupling to the fluid line extending from the RDE 40 towards the vapor injection port 28 of the compressor 12 while dispensing the gaseous refrigerant from the interior of the economizer 70. Each of the described openings 53, 54 may have any suitable structure for mating with a corresponding fluid fitting, coupling, or the like for establishing a seal at the cap 50 for each respective refrigerant flow.

An inlet pipe 55 depends downwardly from the opening 53 for connection to an upper disposed one of the first plates 72*a*, which is shown as including a modified first contact portion 83 and first manifold opening 88 for reception of and coupling to the inlet pipe 55. The inlet pipe 55 provides fluid communication between the opening 53 and the inlet manifold chamber 91. The inlet pipe 55 may also provide a limited degree of heat exchange between the two-phase refrigerant passing through the inlet pipe 55 and each of the gaseous refrigerant within the gas containing portion 43*b* of the tank 42 and liquid refrigerant within the liquid containing portion 43*a* and the tank 42, depending on the level of the liquid refrigerant within the tank 42. An outlet pipe 56 also depends downwardly from the opening 54 for connection to the upper disposed one of the first plates 72*a*, which similarly includes a modified second contact portion 85 and second manifold opening 89 for reception of and coupling to the outlet pipe 56. The outlet pipe 56 provides fluid communication between the outlet manifold chamber 92 and the opening 54. The outlet pipe 56 may also provide a limited degree of heat exchange between the now gaseous refrigerant passing through the outlet pipe 56 and each of the gaseous refrigerant within the gas containing portion 43*b* of the tank 42 and liquid refrigerant within the liquid containing portion 43*a* and the tank 42, depending on the level of the liquid refrigerant within the tank 42.

A lower disposed one of the plates 72, which is shown as one of the first plates 72*a* in FIG. 3, may also be modified to include the removal of the corresponding first and second manifold openings 88, 89 from the respective first and second contact portions 83, 85 thereof, thereby delimiting each of the inlet manifold chamber 91 and the outlet manifold chamber 92 with respect to the axial direction towards the lower arranged second axial end 48 of the tank 42. However, the disclosed first plate 72*a* may alternatively be replaced with a corresponding second plate 72*b* having the same general configuration for delimiting the axial flow of the internally disposed refrigerant, so long as the corresponding contact portions 83, 85 are provided in the absence of the respective manifold openings 88, 89.

According to the disclosed configuration, the refrigerant passing through the tank 42 via the primary circuit 11 and the refrigerant passing through the tank 42 via the branch pathway 25 are fluidly segregated from one another throughout passage through the RDE 40, including with respect to any flow exterior to and interior to each of the inlet pipe 55, the economizer 70 as formed by the stacked arrangement of the plates 72, and the outlet pipe 56, hence there is no mixing between the two different flows of the refrigerant within the RDE 40.

As best shown in FIGS. 2 and 4, a perimeter shape of each of the stacked plates 72 determines a 3-dimensional shape of the resulting stacked heat exchanging structure formed by the cooperation of the alternating plates 72*a*, 72*b*. Specifically, each of the plates 72 includes a substantially circular perimeter shape that has been truncated at each of two diametrically opposing sides. An axis extending between the diametrically opposing sides of the circular shape may be arranged perpendicular to an axis that is itself arranged perpendicular to the axial direction of the tank 42 and extending between the inlet manifold conduit 91 and the outlet manifold conduit 92. In other words, a direction of spacing between the first truncated portion 77 of each of the plates 72 and the opposing second truncated portion 78 of each of the respective plates 72 may be arranged perpendicular to a direction of spacing between the inlet manifold chamber 91 and the outlet manifold chamber 92.

Each of the truncated portions 77, 78 refers to a portion of the otherwise circular peripheral shape of each of the plates 72 that has been indented inwardly from the circular peripheral shape to provide an open space between the periphery of the corresponding plate 72 and the inner circumferential surface 49 of the tank 42, wherein the circularly shaped portions of the periphery of each of the plates 72 are dimensioned to otherwise correspond to and fit to the inner circumferential surface 49 of the tank 42 for preventing axial flow around the plates 72 at those positions devoid of one of the truncated portions 77, 78. The inclusion of each of the truncated portions 77, 78 accordingly forms an open space to each of two diametrically opposing sides of each of the plates 72 through which the liquid refrigerant comprising the liquid containing portion 43*a* of the tank 42 is able to flow axially along the length of the economizer 70, as explained in greater detail hereinafter.

The first truncated portion 77 is formed by an edge 61 of each of the plates 72 extending rectilinearly in parallel to the direction of spacing between the first and second manifold chambers 91, 92. The edge 61 is spaced apart from the inner circumferential surface 49 of the tank 42 in a manner forming an opening having a peripheral shape of a segment of a circle between the edge 61 and the inner circumferential surface 49. The second truncated portion 78 is formed by an edge 62 comprising a first outer segment 63, a center segment 64, and a second outer segment 65. The first outer segment 63 and the second outer segment 65 of the edge 61 are aligned with each other and extend rectilinearly in parallel to the direction of spacing between the inlet and outlet manifold chambers 91, 92 while the center segment 64 is semi-circular in shape and is indented towards a center of each of the plates 72 from the adjacent and straddling outer segments 63, 65. The center segment 64 may be inwardly indented to accommodate passage of the pick-up conduit 45 through the economizer 70 without intruding into the space formed between the aligned outer segments 63, 65 and the inner circumferential surface 49 of the tank 42, wherein such a space once again has the peripheral shape of a segment of a circle. In other embodiments, the edge 62 may be entirely rectilinear in extension in the absence of the center segment 64, wherein the pick-up conduit 45 may be disposed entirely within the open space having the shape of a segment of a circle. The spaces formed by the truncated portions 77, 78 are not necessarily limited to the shape of a segment of a circle, as substantially any shape indented from the circular inner circumferential surface 49 of the cylindrically shaped tank 42 may be utilized, including an arcuate shape (such as semi-circular), rectangular shape, or trapezoidal shape, each of which is indented inwardly towards a center of each of the plates 72. Any shape of the edges 61, 62 forming a space for axial flow of the liquid refrigerant between the inner circumferential surface 49 and the economizer 70 may be utilized while remaining within the scope of the present invention.

With respect to the disclosed configuration, each of the plates 72 includes a peripheral shape including a first circular arc conforming to a first segment of the inner circumferential surface 49 of the tank 42, a first rectilinear line corresponding to the edge 61 that extends from an end of the first circular arc, a second circular arc conforming to a second segment of the inner circumferential surface 49 of the tank 42 that extends from an end of the first rectilinear line, a second rectilinear line corresponding to the first outer segment 63 of the edge 62 that extends from an end of the second circular arc, a semi-circular arc corresponding to the center segment 64 of the edge 62 that extends from the second rectilinear line, and a third rectilinear line corresponding to the second outer segment 65 of the edge 62 that extends from an end of the center segment 64 for connection to the first circular arc. The described peripheral shape is also shared by a shape of the third contact portion 87, the inwardly disposed third axial extension portion 86, and a peripheral shape of the inwardly disposed planar portion 81 of each of the plates 72.

The axial stacking of the plates 72 in the manner previously described results in the heat exchanging structure including the alternating pattern of internal flow passages 75 and external flow passages 76 having a truncated cylindrical shape that is truncated at each of two diametrically opposing sides thereof, as formed by the alignment of the stacked first truncated portions 77 and stacked second truncated portions 78 of each of the plates 72. This results in the formation of a first manifold space 101 between the inner circumferential surface 49 of the tank 42 and the side of the economizer 70 defined by the cooperating first truncated portions 77 (corresponding to the edges 61) as well as a second manifold space 102 between the inner circumferential surface 49 of the tank 42 and the diametrically opposing side of the economizer defined by the cooperating second truncated portions 77 (corresponding to the edges 62). The first manifold space 101 may alternatively be referred to as an inlet manifold space while the second manifold space 102 may alternatively be referred to as an outlet manifold space, by virtue of the direction of flow of the liquid refrigerant within the liquid containing portion 43*a* when flowing through the economizer 70. Each of the manifold spaces 101, 102 may be described as having a shape of a truncated segment of a cylinder, wherein each truncated segment of the cylinder may be formed by a cutting of the corresponding cylindrical shape along a plane arranged parallel to the axial direction of the cylindrical shape and spaced apart from an axis of symmetry of the remainder of the cylindrical shape. The first manifold space 101 may be disposed directly below the dispensing conduit 44 of the cap 50 to promote the separating of the liquid refrigerant entering the tank 42 by gravity towards the first manifold space 101, or the dispensing conduit 44 may be inclined towards the first manifold space 101 for creating a desired angle of entry of the liquid refrigerant therein. The second manifold space 102 includes the pick-up conduit 45 extending therethrough at the diametrically opposing side of the economizer 70 from the first manifold space 101. The second manifold space 102 may include the pick-up conduit 45 extending through the substantially semi-cylindrical space formed by the cooperation of the aligned center segments 64 of the edges 62.

As shown in FIGS. 2 and 3, the economizer 70 may include a cover plate 110 that is disposed axially over the upper disposed one of the plates 72 connected to each of the inlet and outlet pipes 55, 56 towards the first axial end 47 of the tank 42. The cover plate 110 includes a peripheral shape that is circular with the exception of a single truncated portion 111 formed by an edge 112 of the cover plate 110 disposed to be in axial alignment with the edges 61 of the underlying stack of plates 72, thereby forming a space having the shape of a segment of a circle in axial alignment with the first manifold space 101. The cover plate 110 also includes openings 113 formed therethrough for reception of the pipes 55, 56 and the conduit 45 therethrough when the cover plate 110 is connected to the upper surface of the stack of the plates 72. The circular segment of the peripheral shape of the cover plate 110 is fitted to conform to the inner circumferential surface 49 of the tank 42 to prevent the flow of the liquid refrigerant over the top of the economizer 70 and around the periphery thereof, with the exception of the edge 112 forming the truncated portion 111 thereof. The cover plate 110 is provided to cause any liquid refrigerant disposed above the cover plate 110 within the liquid containing portion 43*a* to require flow past the edge 112 and into the first manifold space 101 rather than bypassing the economizer 70 via flow directly to the second manifold space 102. The cover plate 110 is shown in FIG. 2 as having a substantially planar configuration, but in other embodiments the cover plate 110 may have substantially the same form as one of the first plates 72*a*, including having axially extending portions where each of the pipes 55, 56 or conduits 45 extends through the cover plate 110.

As explained previously, the plates 72 are joined adjacent each of the aligned edges 61 of adjacent plates 72*a*, 72*b* such that the liquid refrigerant disposed within the first manifold space 101 is able to be distributed to each of the external flow passages 76 formed between adjacent sets of the plates 72*a*, 72*b*. The flow of the refrigerant into each of the external flow passages 76 occurs generally in the direction of spacing of the first manifold space 101 from the second manifold space 102, which is a direction arranged perpendicular to the axial direction of the tank 42. The liquid refrigerant exits each of the external flow passages 76 and enters the second manifold space 102 while flowing past one of the segments 63, 64, 65 of one of the edges 62. In the illustrated embodiment, the center segment 64 includes one of the previously described rims 88, hence flow into the second manifold space 102 may occur primarily past the outer segments 63, 64 of the edge 62, which are devoid of such a rim 88. In either circumstance, the direction of flow through the external flow passages 76 occurs with the liquid refrigerant flowing from one of the edges 61 to a corresponding one of the edges 62 while flowing from the first manifold space 101 to the second manifold space 102. The described general direction of flow through the internal flow passages 75 between the manifold chambers 91, 92 occurs in a direction perpendicular to the described general direction of flow through the external flow passages 76, hence the flow configuration present between the internal and external flow passages 75, 76 may be said to be a cross-flow configuration.

The heat exchanging structure formed by the stacked plates 72 may include further heat exchanging structures for increasing a total exposed surface area of the economizer 70 exposed to the two different flows of the refrigerant encountering the economizer 70. As shown in FIGS. 3 and 4, a plurality of corrugated fin elements 140 may be disposed between adjacent pairs of the plates 72*a*, 72*b* within each of the internal and external flow passages 75, 76 for increasing the heat exchanging surface present within each of the flow passages 75, 76. Each of the fin elements 140 may contact each of the opposing first major surfaces 73 of the adjacent disposed pairs of plates 72*a*, 72*b* along the external flow passages 76 and may also contact each of the opposing second major surfaces 74 of the adjacent disposed pairs of plates 72*a*, 72*b* along the internal flow passages 75. As best shown in FIG. 4, the fin elements 140 may be disposed between the facing sets of major surfaces 73, 74 along the planar portions 81 of each of the paired plates 72*a*, 72*b*.

Each of the fin elements 140 includes a plurality of corrugations that are spaced apart from one another with respect to the direction of spacing of the inlet manifold chamber 91 from the outlet manifold chamber 92 in a manner wherein a fluid passing through a flow opening formed to either side of one of the corrugations passes in a direction of spacing of the first manifold space 101 from the second manifold space 102. Adjacent ones of the fin elements 140 are also offset from each other with respect to the direction of spacing of the inlet and outlet manifold chambers 91, 92 to cause each of the flow openings formed to one side of each of the corrugations of each of the fin elements 140 to be divided into two flow openings formed to each of two opposing sides of the corrugation of a downstream arranged one of the fin elements 140. The offset may be a variable offset or may be a fixed and alternating offset, as desired. This arrangement causes a fluid passing through the offset fin configuration to encounter a substantially serpentine flow path with respect to each of the flows encountering the economizer 70. Such a serpentine flow path aids in increasing the heat exchange efficiency of the economizer 70 by encouraging mixing of the refrigerant when recombining after encountering successive fin elements 140.

The RDE 40 further includes a drier separation plate 120 disposed axially beneath the economizer 70. The drier separation plate 120 is substantially circular in shape and conforms to the inner circumferential surface 49 of the tank 42 to prevent axial passage of the refrigerant around a periphery of the drier separation plate 120. As shown in FIG. 3, the drier separation plate 120 is spaced apart axially from at least a portion of the lowermost disposed one of the plates 72 to form a drier distribution chamber 122 between the lower surface of the lowermost one of the plates 72 and the drier separation plate 120, wherein the drier distribution chamber 122 is formed within the liquid containing portion 43*a* of the hollow interior 43 of the tank 42. The lowermost disposed one of the plates 72 may be provided devoid of the corresponding manifold openings 88, 89 therein for preventing the liquid from either of the manifolds 91, 92 from flowing directly into the drier separation chamber 122 from the interior of the economizer 70. The drier distribution chamber 122 may accordingly be placed in fluid communication with the liquid refrigerant entering the RDE 40 via the axial flow of the liquid refrigerant through the first manifold space 101, wherein the drier distribution chamber 122 is disposed at the distal end of the first manifold space 101. The drier distribution chamber 122 may also be in fluid communication with the second manifold space 102 at the diametrically opposing side of the economizer 70.

The drier separation plate 120 forms a partition for separating the drier distribution chamber 122 from a desiccant chamber 124 of the hollow interior 43 of the tank 42 with respect to the axial direction thereof. The desiccant chamber 124 is formed within the liquid containing portion 43*a* of the tank 42 and is disposed towards the lower-disposed second axial end 48 of the tank 42. The desiccant chamber 124 includes a desiccant 126 disposed therein. The desiccant 126 may be representative of any material or structure configured to capture moisture carried by the flow of the liquid refrigerant for drying the flow of the liquid refrigerant. The desiccant 126 may, for example, be a silica gel provided in bead form (as shown in the figures), or may be a molecular sieve. Any suitable desiccant 126 may be utilized while remaining within the scope of the present invention.

The drier separation plate 120 includes a plurality of through-holes 121 formed therethrough, wherein each of the through-holes 121 provides fluid communication between the drier distribution chamber 122 and the desiccant chamber 124. During flow of the liquid refrigerant through the economizer 70, a portion of the liquid refrigerant flows along the first manifold space 101 axially before deflecting laterally at the drier separation plate 120 for lateral flow of the refrigerant through the drier distribution chamber 122. At least a portion of the flow of the refrigerant through the drier distribution chamber 122 flows axially into the desiccant chamber 124 through one of the through-holes 121 for interaction with the desiccant 126. The liquid refrigerant disposed within the desiccant chamber 124 eventually flows axially through one of the through-holes 121 back into the desiccant distribution chamber 122. The liquid refrigerant then tends to continue to flow laterally towards the second manifold space 102 for entry into the inlet end 46 of the pick-up conduit 45.

In some embodiments, the through-holes 121 may be distributed primarily towards the first manifold space 101, such as being formed only in a diametric half of the drier separation plate 120 towards the first manifold space 101, for prescribing a desired flow of the liquid refrigerant into and out of the desiccant chamber 124. In other embodiments, the through-holes 121 may be distributed throughout the entirety of the drier separation plate 120, as desired.

The desiccant distribution chamber 122 may include one of the fin elements 140 disposed therein to further improve the heat exchanging capacity of the economizer 70. The liquid refrigerant also passes over the drier separation plate 120 in a manner in which the drier separation plate 120 may also play a role in exchanging heat between the liquid refrigerant and the economizer 70. The desiccant distribution chamber 122 may accordingly be considered to be a lowermost one of the external flow passages 76 receiving the liquid refrigerant therethrough.

As best shown in FIG. 2, a filter 130 may be disposed within the second manifold space 102 at a position wherein all flow of the liquid refrigerant exiting the RDE 40 flows through a screen element 131 of the filter 130 immediately prior to entry into the inlet end 46 of the pick-up conduit 45. In the illustrated embodiment, the filter 130 is constructed with the screen element 131 having a substantially cylindrical shape extending between the drier separation plate 120 and the inlet end 46 of the pick-up conduit 45 such that the liquid refrigerant passes through the screen element 131 laterally when flowing from within the second manifold space 102 and into the interior of the filter 130. The liquid refrigerant within the filter 130 then flows axially towards the inlet end 46 after debris has been filtered from therefrom via the passage through the screen element 131. However, it should be understood that alternative configurations of the filter 130 may be provided at the inlet end 46 of the pick-up conduit 45 without necessarily departing from the scope of the present invention.

In summary, a first flow of the refrigerant associated with the primary circuit 11 flows into the opening 51 of the cap 50 as a two-phase refrigerant. A dispensing conduit 44, which may be formed by or may depend from the opening 51, directs a liquid phase of the refrigerant to accumulate in the liquid containing portion 43*a* of the tank 42 while a gaseous phase of the refrigerant collects within the gas containing portion 43*b* thereof. The cover plate 110 disposed over the top of the economizer 70 ensures that all liquid refrigerant above the cover plate 110 is directed to flow axially downwardly through the first (inlet) manifold space 101. The liquid refrigerant is then distributed to each of the external flow passages 76 for passage to the oppositely arranged second (outlet) manifold space 102. At least a portion of the liquid refrigerant within the first manifold space 101 also flows into the drier distribution chamber 122 for passage into and out of the desiccant chamber 124 via the through-holes 121 in the manner described above, wherein the liquid refrigerant interacts with the desiccant 126 disposed therein to remove any undesirable moisture from the liquid refrigerant. The liquid refrigerant having passed through the external flow passages 76 proceeds along the second manifold space 102 towards the inlet end 46 of the pick-up conduit 45, which also includes the removal of debris from the liquid refrigerant via passage through the screen element 131 of the filter 130. The liquid refrigerant exiting the drier distribution chamber 122 also flows into the second manifold space 102 and through the filter 130 to combine with the liquid refrigerant exiting the external flow passages 76. The liquid refrigerant then enters the inlet end 46 of the pick-up conduit 45 for axial upward flow towards the opening 52 of the cap 50. The liquid refrigerant is then able to proceed downstream to the internal heat exchanger 18.

Meanwhile, a second flow of the refrigerant associated with the vapor injection branch pathway 25 enters the cap 50 via the opening 53 and flows axially downwardly towards the economizer 70 through the inlet pipe 55, wherein the second flow of the refrigerant enters the cap 50 as a two-phase refrigerant. The refrigerant is distributed to the internal flow passages 75 via the inlet manifold chamber 91 and is then recombined within the outlet manifold chamber 92. The second flow of the refrigerant flows through the internal flow passages 75 in a direction perpendicular to the direction the first flow of the refrigerant flows through the external flow passages 76 to form the described cross-flow configuration. The refrigerant flows axially upwardly through the outlet manifold chamber 92 and then continues to flow axially upwardly out of the economizer 70 via the outlet pipe 56 and the corresponding opening 54 formed in the cap 50.

Heat exchange occurs between the first flow of the refrigerant and the second flow of the refrigerant via the economizer 70 to cool the first flow of the refrigerant and heat the second flow of the refrigerant. The cooling of the first flow of the refrigerant leads to a subcooling of the liquid refrigerant to a temperature below the saturation temperature of the refrigerant while the heating of the second flow of the refrigerant leads to an evaporation of the gaseous phase thereof in addition to superheating of the resulting gaseous refrigerant. The subcooled liquid refrigerant increases a cooling capacity of any downstream-arranged evaporator 15 or chiller 22 while the superheated gaseous refrigerant is able to enter the vapor injection compressor 12 via the downstream-arranged vapor injection port 28.

The disclosed vapor injection process may be configured to only occur when the upstream arranged branch expansion element 29 is opened to allow for the flow of the second flow of the refrigerant through the economizer 70. As described above, the opening of the branch expansion element 29 may occur according to a control scheme executed by a controller and an EXV or may be passively controlled via a temperature sensing mechanism of a TXV to ensure that the vapor injection process occurs only when desired.

In addition to the increased subcooling of the refrigerant for increasing the cooling capacity of the refrigerant circuit 10, the disclosed RDE 40 also provides a significant benefit in reducing the total packaging size and complexity of the RDE 40 relative to the refrigerant circuit 10 in comparison to a refrigerant circuit having such components provided independently. This is especially true where the number and orientation of the necessary fluid connections can be reduced to avoid difficult to package components and the like. The use of the RDE 40 accordingly promotes efficient heat transfer while also facilitating the ability to reorient or repackage components of the associated vehicle in accordance with the recaptured packaging space associated with use of the RDE 40.

Figure 6:
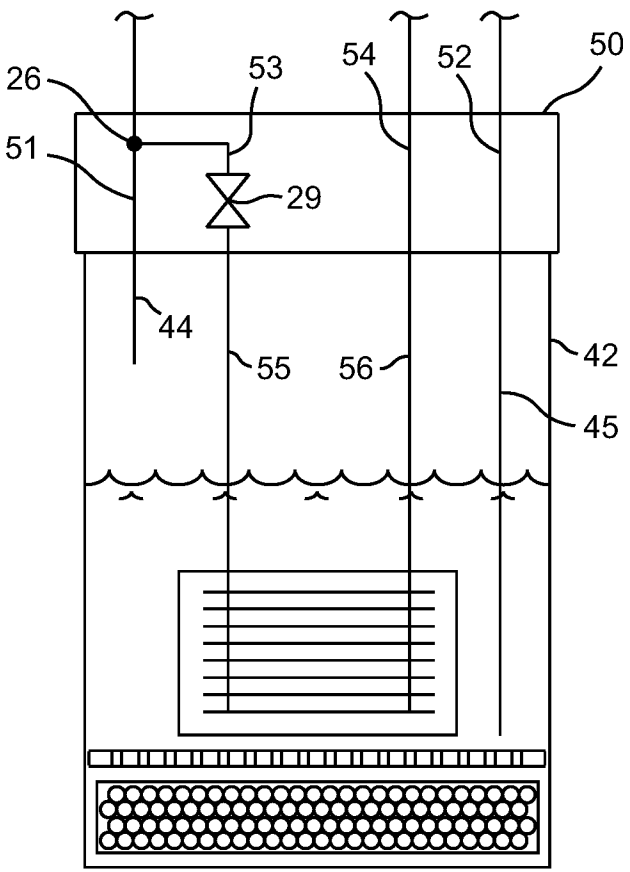
FIG. 6 is a schematic illustration of an integrated receiver drier and economizer having a branch point and an expansion element disposed within the structure of the cap of the tank.
Figure 5:
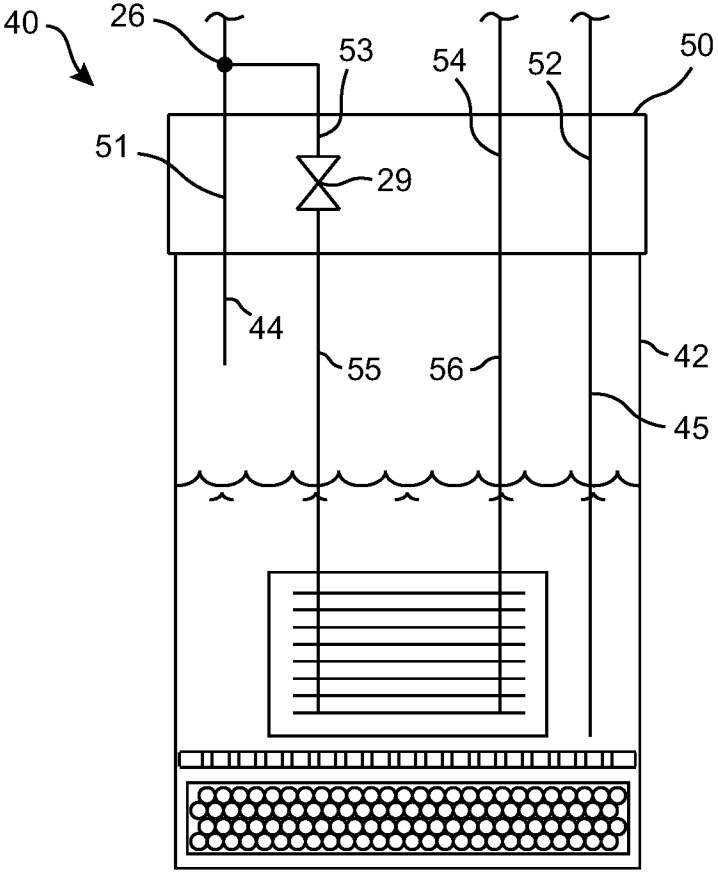
FIG. 5 is a schematic illustration of an integrated receiver drier and economizer having an expansion element disposed within the structure of the cap of the tank and a branch point disposed upstream of the cap for delivering refrigerant to the expansion element.

Referring now to FIGS. 5 and 6, the RDE 40 may be modified to further include the integration of the branch expansion element 29 of the vapor injection branch pathway 25 directly into the structure of the cap 50, such as within the described opening 53 formed within the cap 50 for communicating the refrigerant to the inlet pipe 55. FIG. 5 illustrates a first modification wherein the branch point 26 is maintained at a position upstream of the structure of the cap 50, thereby resulting in two distinct fluid lines branching from the branch point 26 for coupling to corresponding openings 51, 53 of the cap 50. In contrast, FIG. 6 illustrates a second modification wherein the branch point 26 is moved to a position for integration within the structure of the cap 50 in addition to the integration of the branch expansion element 29, thereby resulting in the need for only one fluid line to be coupled to the cap 50 for feeding each of the two openings 51, 53 disposed downstream of the branch point 26. Each of the disclosed modifications beneficially reduces the number of components necessary at positions external to the RDE 40, thereby reducing a packaging space of the resulting RDE 40 while also reducing a number of fluid connections required for coupling the RDE 40 to the remainder of the refrigerant circuit 10.

Figure 7:
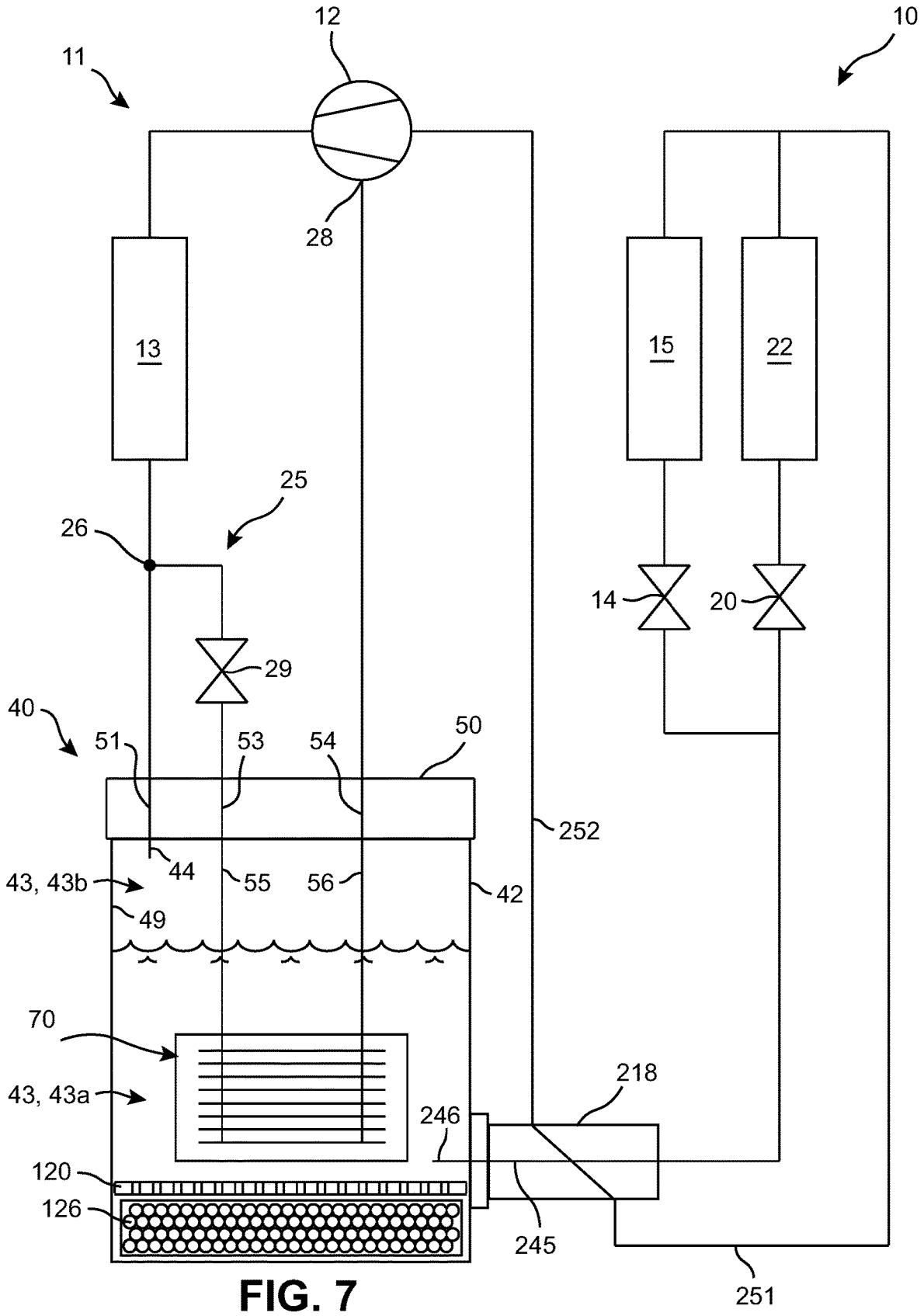
FIG. 7 is a schematic illustration of a refrigerant circuit including an integrated receiver drier economizer, and internal heat exchanger according to another embodiment of the present disclosure, wherein the internal heat exchanger is integrated into a circumferential wall of the tank of the integrated receiver drier, economizer, and internal heat exchanger.
Figure 8:
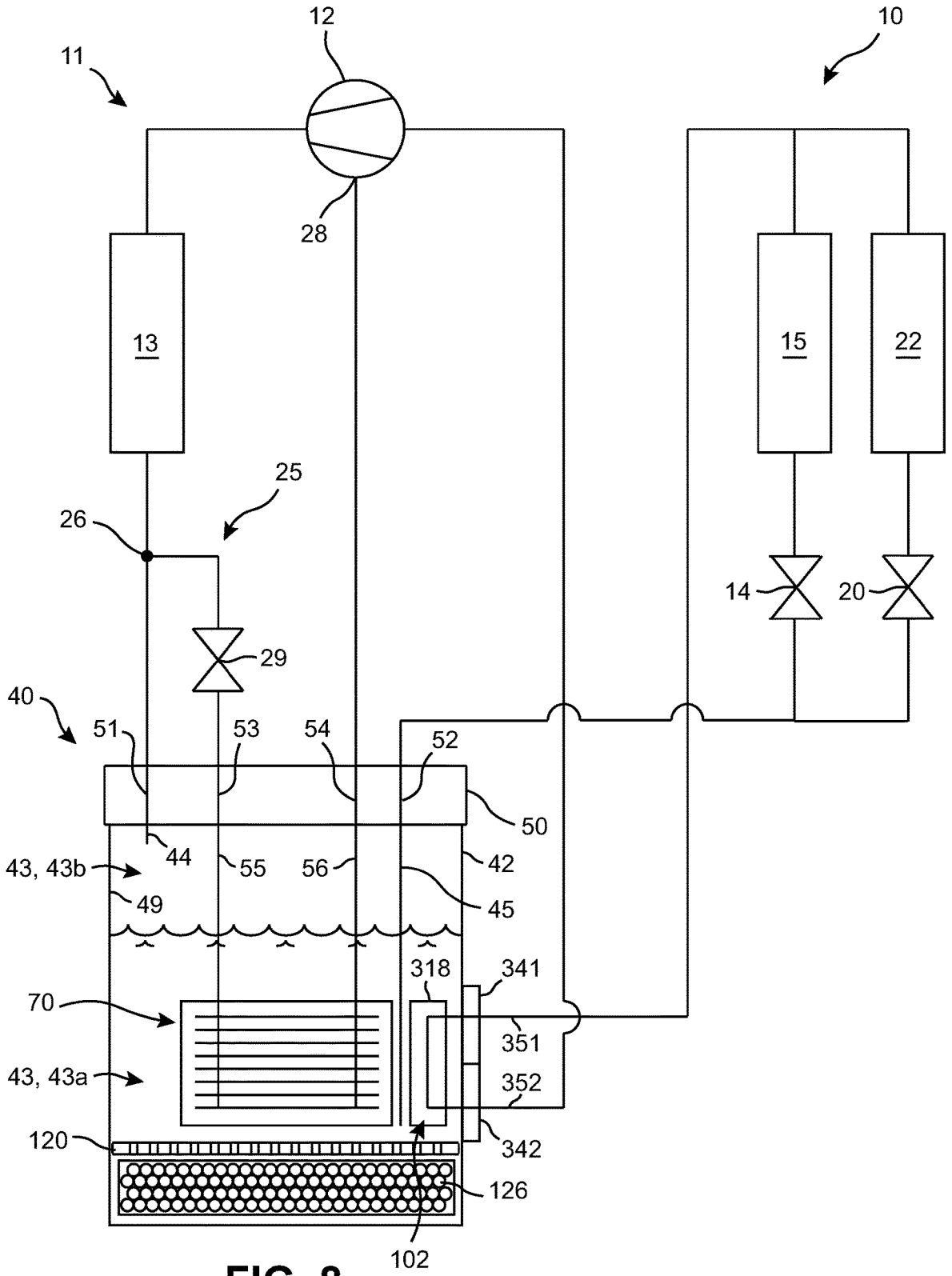
FIG. 8 is a schematic illustration of a refrigerant circuit including an integrated receiver drier, economizer, and internal heat exchanger according to another embodiment of the present disclosure, wherein the internal heat exchanger is disposed within the tank of the integrated receiver drier, economizer, and internal heat exchanger adjacent a circumferential wall of the tank.
Figure 9:
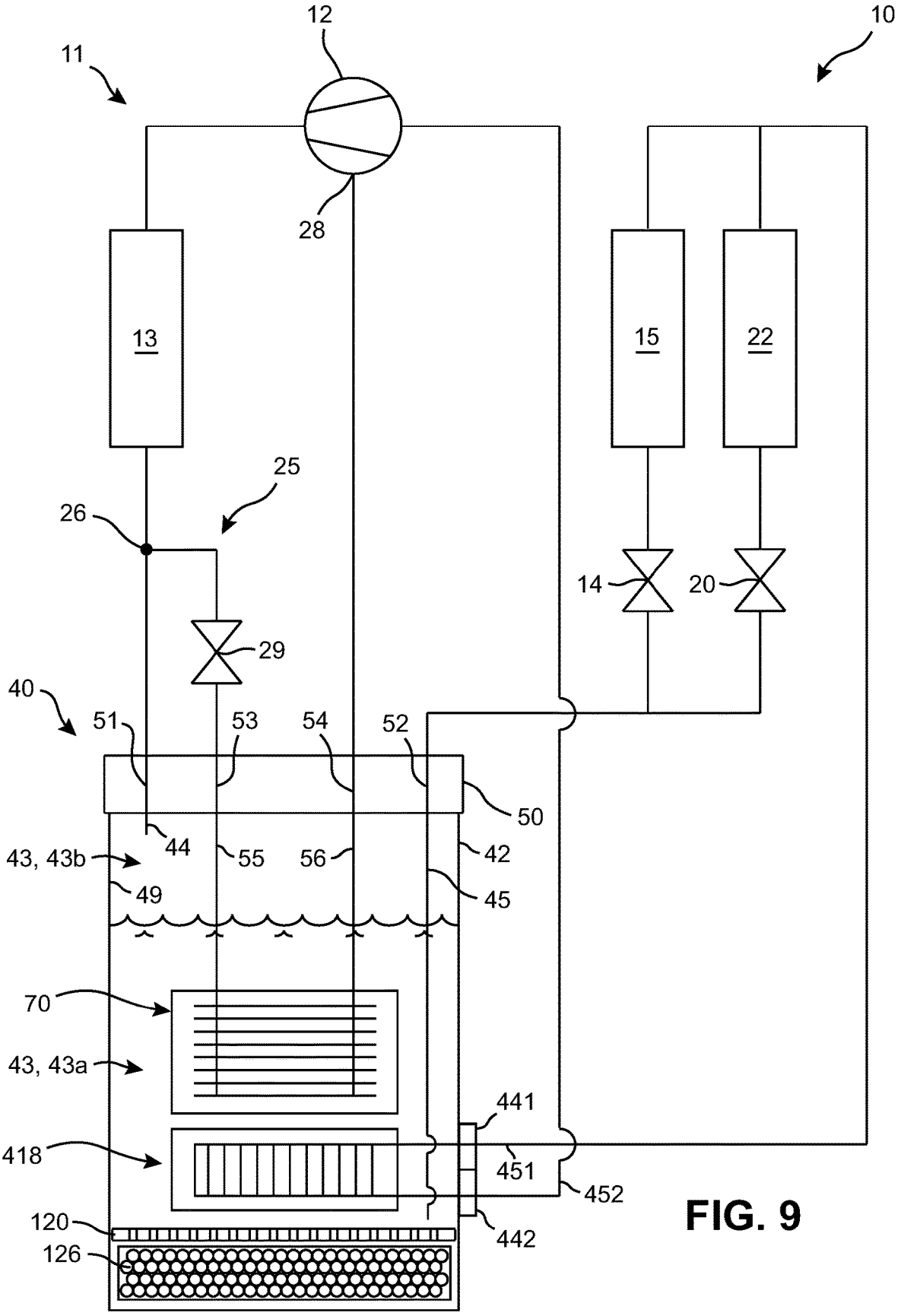
FIG. 9 is a schematic illustration of a refrigerant circuit including an integrated receiver drier, economizer, and internal heat exchanger according to another embodiment of the present disclosure, wherein the internal heat exchanger is stacked below the economizer within the tank of the integrated receiver drier, economizer, and internal heat exchanger.

FIGS. 7-9 illustrate additional variations to the RDE 40 that include the integration of an internal heat exchanger into the structure of the tank 42 of the RDE 40. The introduction of the internal heat exchanger into the structure of the RDE 40 further reduces a packaging size and complexity of the RDE 40 when installed relative to the remainder of the refrigerant circuit 10. The refrigerant circuit 10 shown in each of FIGS. 7-9 operates in identical fashion to the refrigerant circuit 10 of FIG. 1 outside of the modification of the RDE 40 to include the integration of each disclosed internal heat exchanger, hence further description is omitted herefrom.

FIG. 7 schematically illustrates the RDE 40 as including an internal heat exchanger 218 integrated into an outer surface of the tank 42. The RDE 40 includes a pick-up conduit 245 extending (radially) outwardly through an outer circumferential wall of the tank 42, as opposed to extending axially through the cap 50 as does the pick-up conduit 45 of FIG. 1. The pick-up conduit 245 includes an inlet end 246 in fluid communication with the liquid containing portion 43*a* of the tank 42 downstream of the heat exchange occurring within the economizer 70. The pick-up conduit 245 extends radially outwardly beyond the outer circumferential surface of the tank 42 to expose at least a portion of the pick-up conduit 245 exterior to the tank 42. An internal heat exchanger 218 is formed where a fluid line 251 extending from the evaporator 15 and/or the chiller 22 intersects the pick-up conduit 245 for exchanging heat between the high pressure and low pressure flows of the refrigerant at different positions within the primary circuit 10.

In one exemplary embodiment, the internal heat exchanger 218 is formed by a sleeve received over the pick-up pipe 245 for forming an annular space around the pick-up pipe 245 configured to receive the low pressure refrigerant exiting the evaporator/chiller 15, 22 via the fluid line 251. The sleeve may be directly integrated into the structure of the tank 42, and the sleeve may extend radially outwardly from the tank 42 to surround the pick-up conduit 245. The low pressure refrigerant may enter the annular space at a first axial position via the fluid line 251 before exiting the annular chamber at a spaced apart second axial position via a fluid line 252 leading to the inlet side of the vapor injection compressor 12. The fluid lines 251, 252 may be configured to intersect the annular space at diametrically opposing sides thereof to cause the refrigerant flowing through the annular space to flow both axially and circumferentially when passing between the fluid lines 251, 252 via passage through the internal heat exchanger 218. However, the internal heat exchanger 218 is not limited to such a configuration, as any heat exchanging structure present at the outer surface of the tank 42 may be utilized for exchanging heat with the liquid refrigerant when exiting the tank 42.

FIG. 8 schematically illustrates the RDE 40 as including an internal heat exchanger 318 that is disposed directly within the liquid containing portion 43*a* of the tank 42. Specifically, the internal heat exchanger 318 may be disposed within the second manifold space 102 formed between the economizer 70 and the inner circumferential surface 49 of the tank 42 adjacent the axial extension of the pick-up conduit 45. The internal heat exchanger 318 is provided as a heat exchanging structure extending between a first port 341 and a second port 342 of the tank 42. Each of the ports 341, 342 refers to an opening formed through the circumferential wall of the tank 42 for connection to a first fluid line 351 and a second fluid line 352, respectively. The first fluid line 351 refers to the fluid line extending from the evaporator/chiller 15, 22 towards the tank 42 and is configured to be coupled to the first port 341 while the second fluid line 352 refers to the fluid line extending from the tank 42 towards the inlet side of the vapor injection compressor 12. In some embodiments, the first and second ports 341, 342 may be spaced apart from each other axially. In other embodiments, the first and second ports 341, 342 may be spaced apart from each other circumferentially, or a combination of axial and circumferential spacing. The heat exchanging structure forming the internal heat exchanger 318 may have any configuration allowing for the passage of a third flow of the refrigerant through the internal heat exchanger 318 and between the ports 341, 342 while maintaining a segregation of the liquid refrigerant contained within the liquid containing portion 43*a* from the gaseous refrigerant passing through an interior of the internal heat exchanger 318. The internal heat exchanger 318 may be formed by a pipe or conduit extending between the ports 341, 342, wherein the pipe or conduit may include as many turns or bends for providing a desired length of the internal heat exchanger 318 within the liquid containing portion 43*a*. In other embodiments, the internal heat exchanger 318 may be formed by a stacked plate-type heat exchanger having a configuration similar to the economizer 70, but disposed within the space occupied by the second manifold space 102.

FIG. 9 illustrates the RDE 40 as having another example of an internal heat exchanger 418 disposed directly within the liquid containing portion 43*a* of the tank 42. The internal heat exchanger 418 is once again formed by a heat exchanging structure extending from a first port 441 of the circumferential wall of the tank 42 to a second port 442 of the circumferential wall of the tank 42, wherein the first port 441 receives refrigerant from the evaporator/chiller 15, 22 via a fluid line 351 while the second port 442 delivers the refrigerant to the inlet side of the vapor injection compressor 12 via a fluid line 452. The internal heat exchanger 418 differs from the internal heat exchanger 318 by being stacked below the economizer 70 as opposed to being disposed laterally relative thereto. The stacked plate-type heat exchanger formed by the internal heat exchanger 418 may have a configuration that is substantially similar to that of the economizer 70 as formed by the plates 72, except the internal heat exchanger 318 is configured for delivering the gaseous refrigerant therethrough from the circumferentially disposed first and second ports 441, 442, as opposed to the axially arranged pipes 55, 56 of the economizer 70. The stacked heat exchanging structure may accordingly include the removal of the manifold openings from the structure of each of the plates forming the internal heat exchanger 418 to instead have the first port 441 be associated with an inlet manifold for distributing the third flow of the refrigerant to each of the internal flow passages formed through the internal heat exchanger 418 and the second port 442 be associated with an outlet manifold for recombining the third flow of the refrigerant. Each of the plates forming the internal heat exchanger 418 may, for example, include a partition for prescribing a U-shaped flow of the refrigerant therethrough when flowing between the ports 441, 442, as desired. The internal heat exchanger 418 may be disposed relative to the first manifold space 101 and the second manifold space 102 in similar fashion to the economizer 70, and may accordingly prescribe flow of the liquid refrigerant therethrough in substantially similar fashion. The remaining structure of the tank 42 associated with the drier separation plate 120 and the desiccant 126 may be disposed below the internal heat exchanger 418 in similar fashion to that disclosed relative to the economizer 70 of FIGS. 2 and 3.

Each of the embodiments shown through FIGS. 7-9 includes the branch expansion element 29 disposed exterior to the cap 50 of the tank 42, but it should be readily apparent that either of the configurations of FIGS. 5 and 6 may be substituted for any other disclosed embodiment without altering operation thereof, hence such combinations are herein disclosed with respect to the present invention.

Figure 10:
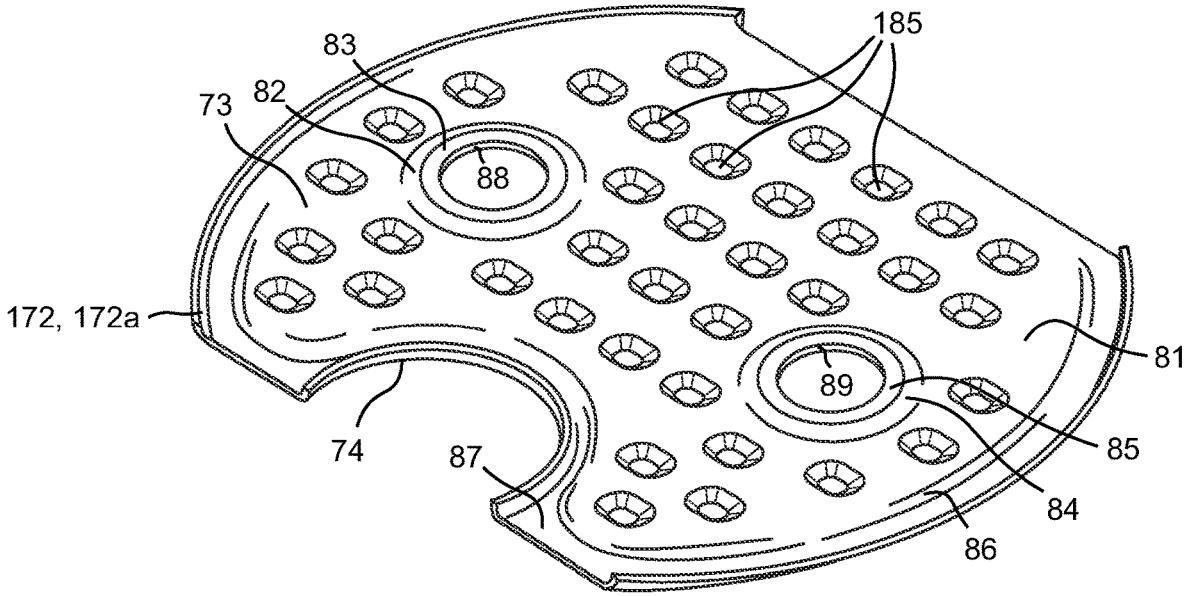
FIG. 10 is a perspective view of an alternative configuration of each of the plates utilized in forming the heat exchanging structure of the integrated receiver drier and economizer according to another embodiment of the present invention.
Figure 11:
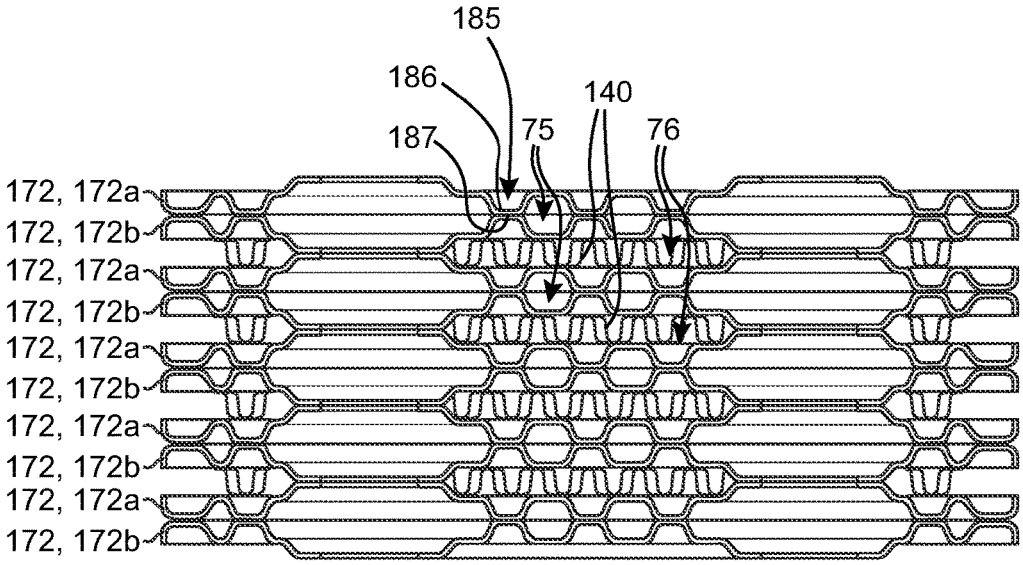
FIG. 11 is an elevational cross-sectional view of a stack of plates according to the configuration disclosed in FIG. 10, wherein the stack of plates includes axially aligned flow structures forming flow divisions therein.

Referring now to FIGS. 10 and 11, an alternative configuration of the economizer 70 may be produced via the utilization of an alternating stack of first plates 172*a* and second plates 172*b* according to another embodiment of the present invention. The stack of the plates 172*a*, 172*b* is configured for reception within the hollow interior 43 of the tank 42 in the same manner as shown with respect to the plates 72*a*, 72*b* of FIGS. 2 and 3 and also operates in the same manner except where noted hereinafter. The stack of the plates 172*a*, 172*b* may be capped at one end by the disclosed cover plate 110 (or equivalent thereto) and at the other end by the drier separation plate 120 in the same manner as the plates 72*a*, 72*b*, and accordingly results in the same general flow configuration of the liquid refrigerant over and through the stack of the plates 172*a*, 172*b* as that described with reference to the stack of the plates 72*a*, 72*b*. The plates 172*a*, 172*b*, the cover plate 110, and the drier separation plate 120 may all be fitted to the size and shape of the inner circumferential surface 49 of the tank 42 to prevent undesired axial flow of the refrigerant between the different elements 172*a*, 172*b*, 110, 120 for bypassing the described flow configurations. The inlet pipe 55, the outlet pipe 56, and the pick-up conduit 45 may all have the same relationships relative to the stack of the plates 172*a*, 172*b* as is disclosed with reference to the stack of the plates 72*a*, 72*b* for establishing the same flow configurations therethrough.

Each of the plates 172*a*, 172*b* includes substantially identical structure to each of the corresponding plates 72*a*, 72*b* of FIGS. 3 and 4 with the exception of the addition of flow structures 185 therein, hence identical reference characters are utilized herein in referring to common features present between each of the plates 72*a*, 72*b*, 172*a*, 172*b*. The first plate 172*a* is also substantially identical to the second plate 172*b* and configured for symmetric arrangement thereto when placed in a stacked configuration, hence specific description is limited hereinafter to the first plate 172*a* exclusively.

In the illustrated embodiment, each of the flow structures 185 is formed as an indentation 186 extending axially into the first major surface 73 of the associated plate 172 for forming a corresponding projection 187 in the opposing second major surface 74 thereof. The formation of each of the flow structures 185 into each of the plates 172 accordingly increases a surface area of each of the plates 172 in comparison to a plate having a planar configuration, such as is disclosed with respect to the corresponding surfaces of each of the plates 72. This increase in surface area accordingly allows for an increased heat exchange efficiency of the plates 172. Each of the flow structures 185 includes a substantially rounded rectangular perimeter shape in the illustrated embodiment, but the flow structures 185 may include substantially any perimeter shape while remaining within the scope of the present invention. The flow structures 185 may also include any inclination of the surfaces forming the indented or projecting surfaces thereof, as desired.

In the illustrated embodiment, each of the projections 187 formed by one of the flow structures 185 of one of the first plates 172*a* is configured to extend towards and contact another one of the projections 187 of one of the second plates 172*b* that is axially aligned therewith, thereby adding additional points of contact between each of the pairings of the plates 172*a*, 172*b* along the same plane as the contact established along the corresponding third contact portions 87 of each of the pairings of the plates 172*a*, 172*b*. The projections 187 of adjacent plates 172*a*, 172*b* may be coupled to each other by means of an aggressive joining process such as brazing, as desired, and may be coupled to each other when the stack of the plates 172*a*, 172*b* is coupled together at the remaining contact portions 83, 87. The contact present between the adjacent projections 187 results in the formation of flow divisions within each of the internal flow passages 75 where the refrigerant passing through the internal flow passages 75 can divide and then recombine. The axial extension of the indentations 186 also results in a variable expansion and contraction of each of the external flow passages 76 as the liquid refrigerant passes by the indentations 186. The addition of the flow structures 185 accordingly aids in introducing turbulence into the corresponding fluid flows and/or promoting increased mixing of each of the corresponding fluid flows, each of which aids in promoting improved heat exchange efficiency of the plates 172 in addition to the effects realized by the increase in surface area described above.

The flow structures 185 are shown in FIG. 10 as having a hexagonal or honey-comb like pattern relative to the planar portion 81 of each of the plates 172, also referred to as an alternating offset pattern, for forming a slaloming or serpentine shaped flow of the refrigerant when passing through the internal flow passages 75. However, the flow structures 185 may have alternative configurations or patterns along the planar portion 81, including irregular arrangements, while remaining within the scope of the present invention. The flow structures 185 may also be provided at any desired density within the planar portion 81 for prescribing the desired degree of heat exchange.

The stack of the plates 172*a*, 172*b* shown in FIG. 11 includes the incorporation of the fin elements 140 therein for further improving the heat exchange capacity present within each of the external flow passages 76. That is, the stack of the plates 172*a*, 172*b* includes a repeating pattern of one of the first plates 172*a*, one of the second plates 172*b*, and one of the fin elements 140, which results in each of the fin elements 140 being disposed axially between one of the second plates 172*b* of a first pairing of the plates 172*a*, 172*b* and one of the first plates 172*a* of a second and adjacent pairing of the plates 172*a*, 172*b*.

In alternative embodiments, the fin elements 140 may be shaped for reception along portions of the internal flow passages 75 devoid of the flow structures 185, thereby resulting in additional layers of the fin elements 140. In yet other embodiments, the flow structures 185 may extend from the planar portion 81 in an opposite axial direction for establishing the flow divisions within the external flow passages 76 in the same fashion as that described with reference to the internal flow passages 75. In some embodiments, the flow structures 185 may extend axially in both axial directions for establishing flow divisions within each of the flow passages 75, 76. In other embodiments, at least some of the flow structures 185 do not contact the flow structures 185 of an adjacent plate 172, thereby establishing those flow structures 185 as projections extending into the corresponding flow passage 75, 76 for diverting flow absent the complete segregation and division thereof.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An integrated receiver drier and economizer comprising:

a tank having a hollow interior receiving a first flow of a refrigerant therein, the first flow of the refrigerant including a liquid phase of the refrigerant accumulating within a liquid containing portion of the hollow interior of the tank; and an economizer receiving a second flow of the refrigerant through an interior thereof, the economizer at least partially submerged in the liquid containing portion of the tank, the economizer forming a heat exchanging structure configured to exchange heat between the first flow of the refrigerant passing over an exterior of the economizer and the second flow of the refrigerant passing through the interior of the economizer.

2. The integrated receiver drier and economizer of claim 1, wherein the tank includes a desiccant disposed within the liquid containing portion thereof.

3. The integrated receiver drier and economizer of claim 2, wherein the desiccant is disposed within a desiccant chamber formed within the tank adjacent an axial end of the economizer, wherein at least a portion of the first flow of the refrigerant passes through the desiccant chamber.

4. The integrated receiver drier and economizer of claim 1, wherein the second flow of the refrigerant enters the interior of the economizer as a two-phase refrigerant having a liquid phase and a gaseous phase and exits the interior of economizer as a gaseous refrigerant.

5. The integrated receiver drier and economizer of claim 1, wherein heat is transferred from the first flow of the refrigerant to the second flow of the refrigerant through the economizer to subcool the first flow of the refrigerant below a saturation temperature of the refrigerant.

6. The integrated receiver drier and economizer of claim 1, wherein the economizer includes a plurality of external flow passages receiving the first flow of the refrigerant therein and a plurality of internal flow passages receiving the second flow of the refrigerant therein.

7. The integrated receiver drier and economizer of claim 6, wherein each of the internal flow passages is in fluid communication with each of an inlet manifold chamber and an outlet manifold chamber formed within the interior of the economizer.

8. The integrated receiver drier and economizer of claim 7, wherein the tank includes a cap covering an axial end thereof, wherein an inlet pipe extends in an axial direction of the tank between the cap and the inlet manifold chamber of the economizer, and wherein an outlet pipe extends in an axial direction of the tank between the cap and outlet manifold chamber.

9. The integrated receiver drier and economizer of claim 8, wherein the first flow of the refrigerant further includes a gaseous phase of the refrigerant occupying a gas containing portion of the hollow interior of the tank, wherein each of the inlet pipe and the outlet pipe extends at least partially through the liquid containing portion of the tank and the gas containing portion of the tank.

10. The integrated receiver drier and economizer of claim 6, wherein the internal flow passages and the external flow passages alternate with respect to an axial direction of the tank.

11. The integrated receiver drier and economizer of claim 6, wherein each of the external flow passages is in fluid communication with each of a first manifold space and a second manifold space, wherein the first manifold space is disposed between the economizer and an inner circumferential surface of the tank at a first side of the tank and wherein the second manifold space is disposed between the economizer and the inner circumferential surface of the tank at a second side of the tank disposed diametrically opposite the first side of the tank.

12. The integrated receiver drier and economizer of claim 6, wherein the economizer includes a plurality of corrugated fin elements disposed within one of the internal flow passages or within one of the external flow passages.

13. The integrated receiver drier and economizer of claim 12, wherein each of the corrugated fin elements is offset laterally from an adjacent one of the plurality of the corrugated fin elements.

14. The integrated receiver drier and economizer of claim 1, further comprising an internal heat exchanger at least partially submerged within the liquid containing portion of the tank, the internal heat exchanger receiving a third flow of the refrigerant through an interior thereof, wherein the third flow of the refrigerant is gaseous in phase, and wherein the internal heat exchanger is configured to exchange heat between the first flow of the refrigerant and the third flow of the refrigerant.

15. A refrigerant circuit comprising:

a primary circuit including, in an order of a first flow of a refrigerant therethrough, a vapor injection compressor, a condenser, a tank, a primary expansion element, and an evaporator, wherein the tank has a hollow interior including a liquid containing portion occupied by a liquid phase of the first flow of the refrigerant; and a vapor injection branch pathway extending from a branch point disposed between the condenser and the tank along the primary circuit to a vapor injection port of the vapor injection compressor, the vapor injection branch pathway including, in an order of a second flow of the refrigerant therethrough, a branch expansion element and an economizer, wherein the economizer is at least partially submerged within the liquid containing portion of the tank, wherein the economizer is a heat exchanging structure configured to exchange heat between the first flow of the refrigerant passing over an exterior of the economizer and the second flow of the refrigerant passing through an interior of the economizer.

16. The refrigerant circuit of claim 15, wherein the tank includes a desiccant disposed within the liquid containing portion thereof, wherein the desiccant is disposed within a desiccant chamber formed within the tank adjacent an axial end of the economizer, wherein at least a portion of the first flow of the refrigerant flows through the desiccant chamber.

17. The refrigerant circuit of claim 15, wherein the branch expansion element is one of an electronic expansion valve or a thermal expansion valve.

18. The refrigerant circuit of claim 15, wherein heat is transferred from the first flow of the refrigerant to the second flow of the refrigerant through the economizer to subcool the first flow of the refrigerant below a saturation temperature of the refrigerant.

19. The refrigerant circuit of claim 15, wherein the second flow of the refrigerant enters the interior of the economizer as a two-phase refrigerant having a liquid phase and a gaseous phase and exits the interior of economizer as a gaseous refrigerant for entry into the vapor injection compressor via the vapor injection port.

20. The refrigerant circuit of claim 15, further comprising an internal heat exchanger disposed along the primary circuit and configured to exchange heat between a low pressure portion of the first flow of the refrigerant and a high pressure portion of the first flow of the refrigerant, wherein the internal heat exchanger is disposed within the liquid containing portion of the tank.

* * * * *